United States Patent [19]

Johnson

[11] Patent Number: 4,538,939

[45] Date of Patent: Sep. 3, 1985

[54] METHOD FOR BALLASTING A VESSEL

[75] Inventor: Jerry R. Johnson, Edmond, Okla.

[73] Assignee: Transworld Drilling Company, Oklahoma City, Okla.

[21] Appl. No.: 581,453

[22] Filed: Feb. 17, 1984

[51] Int. Cl.[3] ..... E02B 17/00

[52] U.S. Cl. ..... 405/205; 405/195; 405/203

[58] Field of Search ..... 405/195, 203–208, 405/224; 166/355; 114/265

[56] References Cited

U.S. PATENT DOCUMENTS

| | | | |
|---|---|---|---|
| 2,889,795 | 6/1959 | Parks | 405/224 X |
| 3,490,406 | 1/1970 | O'Reilly et al. | 405/224 X |
| 3,616,773 | 11/1971 | Lloyd | 114/265 |
| 3,835,800 | 9/1974 | Lloyd | 114/265 |
| 3,894,503 | 7/1975 | McClure | 114/265 |
| 4,165,702 | 8/1979 | Lloyd et al. | 114/265 |
| 4,232,625 | 11/1980 | Goren et al. | 114/265 X |
| 4,257,718 | 3/1981 | Rosa et al. | 405/167 |
| 4,281,615 | 8/1981 | Wilson et al. | 114/265 |

*Primary Examiner*—Dennis L. Taylor

*Attorney, Agent, or Firm*—William G. Addison

[57] ABSTRACT

A method for ballasting a vessel in which a sequence of subsets of ballast tanks, each subset comprising three tanks of the totality of ballast tanks of the vessel, is used to arrive at a final ballast configuration. For each subset in the sequence excepting the last subset, ballast adjustments are repetitively selected and assigned to members of the subset until a selected ballast adjustment will completely fill or completely empty the ballast tank to which the adjustment is assigned. Thereafter, a new subset is selected. In the final subset of the sequence ballast adjustments are repetitively selected and assigned to members of the subset until the total weight of the vessel and ballast, including the ballast assignments, is within a preselected tolerance of a preselected, desired total weight for the vessel and ballast. The ballast adjustments for at least a part of the method decrease with each repetition of the ballast adjustment selection and assignment so that the location of the vessel and ballast center of gravity sequentially approaches a preselected, desired location for the center of gravity of the vessel and ballast as the total weight of the vessel and ballast approaches the preselected, desired total weight for the vessel and ballast.

19 Claims, 8 Drawing Figures

METHOD FOR BALLASTING A VESSEL

BACKGROUND OF THE INVENTION

1. Field of the Invention

The present invention relates generally to improvements in the art of ballasting vessels and, more particularly, but not by way of limitation, to the ballasting of drilling platforms.

2. Brief Discussion of the Prior Art

When a vessel; for example, a ship or a drilling platform, is at rest in a body of water, it is in a condition of mechanical equilibrium under the influence of several forces that are exerted upon it. These forces include the weight of the vessel including loads the vessel may be carrying, the buoyant force on the vessel and, in the case of a submersible drilling platform, constraint forces that the seabed exerts upwardly on pads at the lower ends of the platform legs when the vessel is submerged to the seabottom.

For the equilibrium to exist, Newton's laws of motion require that two conditions be met: (1) there must be no net force on the vessel and (2) there must be no net torque on the vessel about any axis drawn thereon. Since these conditions are the direct consequence of natural laws, it follows that the vessel will position itself in the water or on the seabed so that the two conditions are met. For example, if the distribution of the weight and buoyant force on a ship are such that the two conditions can be met only if the ship floats on its side, the ship will capsize if placed in the water. Similarly, a drilling platform will rise off the seabed or dig on a leg into the seabed if such is required to cause the two conditions to be met.

Ballasting is used to achieve a concurrence of the two conditions of equilibrium with other conditions on the state of the vessel that are imposed by the vessel user. Perhaps the most widely imposed condition is that on the position of a ship in the water; ballasting is used to cause the conditions of equilibrium to be met when the ship is riding on even keel with a selected draft. However, ballasting can also be used to impose other conditions on other types of vessels. For example, in the drilling of an offshore well from a submersible drilling platform, ballasting is often used to achieve an even distribution of the forces between the pads on the legs of the drilling platform and the seabed.

In general, the two conditions of equilibrium and the additional, imposed, conditions, whatever these conditions might be, can be concurrently satisfied by appropriately positioning the combined center of gravity of the vessel with its contents, including ballast, and by attaining an appropriate total weight for the vessel with its contents and ballast. Thus, in the first of the two examples above, the ship would be ballasted so that the combined center of gravity of the ship and ballast would be disposed directly above the ship's keel and the total weight for the ship and ballast would be selected to equal the buoyant force on the ship at the selected draft. In the case of the drilling platform, the location of the center of gravity of the ballasted platform and the weight of the platform and ballast would be selected in accordance with circumstances at hand. For example, during drilling operations, these quantities might be periodically adjusted to limit shifts in the location of the center of gravity of the platform, including drill pipe it carries, as the pipe is moved from storage and added to the drill string. On the other hand, if the platform is to be moved to a new location, an appropriate initial choice for these quantities, preparatory to lifting the platform from the seabed, would be a generally central location of the center of gravity on the platform and a total weight equal to the buoyant force on the platform. With this choice, a further reduction of the total weight of the platform and its ballast can be used to lift the platform off the seabed without causing excessive tilting of the platform. In any event, the appropriate location for the vessel and ballast center of gravity and the total vessel and ballast weight can be determined by standard techniques prior to a commencement of any adjustment to the ballast configuration.

In the past, the ballasting of a vessel has been often a matter of trial and error. For example, where the vessel is afloat so that the effect of a ballast change can be immediately assessed by the person carrying out the ballasting operation, the usual approach is to add or remove ballast from various ones of a set of ballast tanks with which the vessel is provided while observing the effect of each ballast change until the vessel is in trim with a selected draft. A problem with the trial and error approach in these circumstances is that a large number of ballast tanks on the vessel might be partially filled when the ballasting operation is completed. Thus, when the vessel rolls, the ballast in those tanks will shift and thereby reposition the combined center of gravity of the vessel and ballast. This repositioning of the total center of gravity destabilizes the vessal and, where enough tanks are partially filled, will bring the vessel to an unstable condition.

Similarly, difficulties arise with the trial and error approach where a vessel, such as an offshore drilling platform, is partially supported by the seabed. In this case, the effect of a ballast adjustment will not be visible so that a different trial and error approach is used. Generally, the ballaster will determine the total weight the vessel and ballast must have and the location of the combined center of gravity of the vessel and ballast to meet his ends and then find a particular ballast configuration that will result in the so-determined weight and center of gravity of the vessel and ballast. In finding this configuration, he will use his intuition to select an initial trial ballast configuration from which he can calculate a center of gravity and weight for the ballasted vessel. The calculated center of gravity and weight are then compared to the center of gravity and weight the ballasted vessel is to have and the trial ballast configuration adjusted accordingly. This procedure continues until the ballaster arrives at a ballast configuration for which the total weight of the vessel and ballast and the center of gravity of the vessel and ballast match the weight and center of gravity that the ballasted vessel is to have within acceptable tolerances.

One problem with this approach is that the time and effort the approach involves depends upon the intuition of the ballaster. A number of trial ballast configurations, each requiring a center of gravity and weight determination, may be required to find a ballast configuration that will result in the necessary match. In most cases, the final determination of a proper ballast configuration is the result of a series of calculations the complexity of which presents opportunity for human error. Such errors can be disastrous. For example, if an offshore drilling platform is being ballasted to bring the platform to neutral buoyancy preparatory to lifting the platform from the seabed, the platform can suddenly break free from the seabed when an attempt is made to achieve a free floating condition with the result that the platform can capsize or rise on a tilt that will cause large scale shifting of equipment on the platform. In this regard, it should be noted that the trial and error approach to arriving at a proper ballast configuration for a vessel partially supported by the seabottom provides no information to the ballaster in regard to the manner in which the ballast configuration is to be achieved. That is, once the appropriate ballast configuration has been determined, the ballaster must again rely upon his intuition to bring the vessel to this configuration. In some circumstances, an intermediate ballast configuration may be unsafe even though the final ballast configuration determined by the trial and error approach may be safe. Thus, any lapse in the judgment or calculations of the ballaster can have consequences that bear on the safety of the crew of the vessel and on the structural integrity of the vessel and its load.

SUMMARY OF THE INVENTION

The present invention solves these problems by providing a ballasting method that does not rely on the intuition of the person doing the ballasting and, in addition, provides several additional benefits. These include a limitation on the number of partially filled tanks in the ballasted vessel and a capability for carrying out all calculations involved in the ballasting on a small computer or programmable calculator to eliminate the possibility of making an error in the final ballast configuration determination. Moreover, the method specifies not only the final ballast configuration that the vessel is to have but permits the ballaster to select a series of ballast adjustments that can be safely and quickly made to achieve such final configuration.

To this end, the method of the present invention contemplates that the ballasting will be carried out using a series of subsets of the set of ballast tanks with which the vessel is provided, each subset comprising three of the complete set of ballast tanks. For each subset, a series of ballast adjustments are determined and each ballast adjustment is assigned to one member of the subset. The determination of these ballast adjustments, and the assignment of each adjustment to a member of the subset, continues until the totality of adjustments assigned to one member of the subset suffices to exhaust the capacity of such member to receive further adjustments. Thus, for example, where the weight of the ballast carried by the vessel is being increased, ballast adjustments will be made to members of a subset of ballast tanks until a ballast adjustment will cause a member of the subset to be completely filled. If the ballasting is being carried out to lighten the vessel, the ballast adjustments are assigned to the subset until a ballast adjustment will cause a ballast tank that is a member of a current subset to be completely emptied. Thereafter, a new subset is selected by replacing the exhausted tank with a new tank and the determination and assignment of ballast adjustments is continued until the total weight of the vessel and ballast is within a preselected tolerance of a preselected, desired vessel and ballast weight. Thus, at the conclusion of the ballasting process, the total number of ballasting tanks that will be partially filled is equal to three, the number of ballasting tanks that are chosen to make up a subset of ballast tanks. (Where a vessel has previously been ballasted by the intuitive approach, more than three tanks can be partially filled at the conclusion of the present method. However, each time the vessel is ballasted, the number of partially filled tanks is reduced until eventually only three tanks will remain partially filled when the ballasting is completed.)

In addition to limiting the number of partially filled tanks that will exist in the ballasted vessel, the method of the present invention eliminates any need on the part of the ballaster to use his intuition in carrying out the actual ballasting of the vessel. Rather, the method defines a precise sequence of ballast adjustments which, if followed, will bring the vessel to the proper ballast configuration safely and quickly. Thus, the ballaster can merely introduce ballast into the ballast tanks in accordance with a determinable schedule to achieve a proper ballast configuration for the vessel.

Moreover, the method of the present invention permits the ballaster to impose arbitrary conditions not only on the selection of subsets to be used in the ballasting method but also upon the sizes of the ballast adjustments to be made in effectuating the ballasting of the vessel. Thus, for example, the ballaster can optimize the vertical location of the combined center of gravity of the vessel and ballast by arbitrarily choosing his initial subsets to be located near lower portions of the vessel. Similarly, the ballaster can choose the sizes of the ballast adjustments in accordance with a preselected criterion so that the effect of making any one ballast adjustment on the trim of the vessel will not have an appreciable effect on the stability of the vessel. That is, the vessel will be stable at all times thoughout the ballasting procedure.

In general, the method of the present invention contemplates that an initial subset of ballast tanks will be chosen to commence the ballasting operation and several techniques are provided for making the selection of the initial subset of ballast tanks to be used in carrying out the ballasting method. Thereafter, when one ballast tank in a subset is eliminated by such ballast tank being either completely filled or completely emptied, the method provides for the choice of a replacement ballast tank which will permit the ballasting method to continue. Such replacement is selected to insure that the members of the subset upon which ballast adjustments are to be made at any time define a triangle which includes the projection of the desired location of the center of gravity of the vessel and ballast on a horizontal plane once the ballasting method has been completed. In addition, the method provides a particular choice for the ballast tank in a subset that is to receive each ballast adjustment and such choice is made to cause the greatest shift in the location of the center of gravity of the vessel and ballast from a current vessel and ballast center of gravity toward the desired location of the center of gravity of the vessel and ballast. In conjunction with a steady decrease in the sizes of the ballast adjustments, at least toward the termination of the ballasting method, such selection will cause the center of gravity of the vessel and ballast to converge on the desired location of the vessel and ballast center of gravity as the ballast adjustments bring the weight of the vessel and ballast to within a preselected tolerance of a desired weight for the vessel and ballast.

An important object of the present invention is to eliminate the use of intuition in the ballasting of a vessel by a person carrying out such ballasting.

Another important object of the present invention is to provide a ballasting method that can be used to arrive at a proper ballast configuration in a variety of circumstances in which a vessel might be ballasted.

Another object of the invention is to eliminate dangers which have occurred in the past in the ballasting of vessels.

Another object of the invention is to provide a ballasting method that will permit the person doing the ballasting to quickly arrive at a series of ballast adjustments that will appropriately position the combined center of gravity of the vessel and ballast and appropriately establish a combined weight for the vessel and ballast.

Still another object of the invention is to provide a ballasting method which limits the number of ballasting tanks on a vessel which are only partially filled at the conclusion of ballasting of the vessel.

Another object of the present invention is to provide a ballasting method that is particularly suited to the safe ballasting of offshore drilling platforms.

Other objects, advantages and features of the present invention will become clear from the following detailed description of the preferred embodiment of the invention when read in conjunction with the drawings and appended claims.

BRIEF DESCRIPTION OF THE DRAWINGS

FIG. 8 is a flow chart illustrating an alternative sequence of steps for effecting the ballasting method of the present invention.

DESCRIPTION OF THE BALLASTING METHOD

Figure 1:
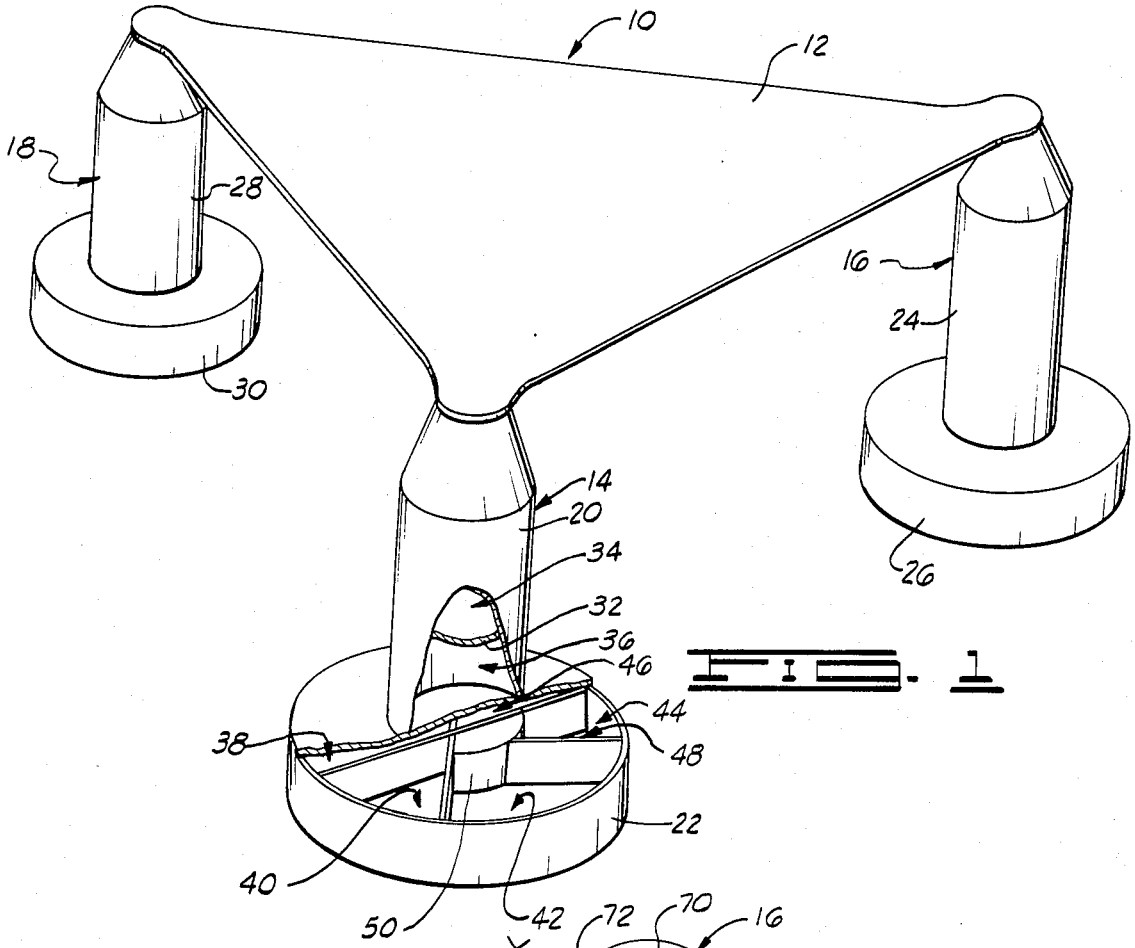
FIG. 1 is a schematic perspective view of a drilling platform illustrating the typical locations of ballast tanks employed in the ballasting method of the present invention.

An important aspect of the ballasting method of the present invention is that its use is not limited to any particular type of vessel that a ballaster might wish to ballast nor to any particular results the ballaster might wish to achieve. Rather, the invention provides a general method for safely achieving a proper ballast configuration under substantially any circumstances in which ballasting might be employed. Accordingly, it will be useful to consider several examples of the use of the method to ballast a vessel and these examples conveniently can be illustrated by considering a particular type of vessel for which ballasting is used to achieve a variety of ends. This vessel is an offshore drilling platform. At times, the drilling platform is floated to move the platform from one drilling site to another and ballasting of a floating platform can be used to adjust the draft of the platform in the water. At other times, the legs of the platform rest on the seabed and ballasting can be used to distribute the unbuoyed portion of the platform's weight among pads at the lower ends of the legs of the platform. In addition, the method of the present invention is particularly useful for making transitions between these two conditions of support of an offshore drilling platform; that is, the method can be used to lower the platform to the seabed or to achieve neutral buoyancy of the platform preparatory to lifting the platform from the seabed.

In order to present the use of the ballasting method of the present invention to ballast an offshore drilling platform, it will be useful to first provide a general description of the construction of such a platform to include the manner in which ballast tanks are incorporated therein. For this purpose, a typical offshore drilling platform has been schematically illustrated in FIGS. 1 and 2 and designated by the general reference numeral 10 therein.

As shown in these Figures, the platform 10 is generally comprised of a deck 12, upon which drilling equipment (not shown) can be mounted for carrying out the drilling operations for which the platform 10 is designed. (The platform 10 will also include buildings mounted on the deck 12 and forming a part of the drilling platform 10. For clarity of illustration of the method of the present invention, such buildings have not been illustrated in the drawings.) The deck 12 is supported by legs 14, 16 and 18 which bear on the seabed during drilling operations and which are lifted from the seabed, by appropriate ballasting of the platform 10, should it be desired to move the platform 10 to a new drilling site. (The legs 14, 16 and 18 are interconnected by struts which form the platform 10 into a rigid whole. For clarity of illustration, the struts have not been shown in the drawings.) In the particular type of offshore drilling platform that has been illustrated in FIGS. 1 and 2 for purposes of discussion, the deck 12 has a triangular shape and the legs 14, 16 and 18 depend from the vertices of the deck 12. However, it is to be understood that the offshore drilling platform may have a deck of substantially any shape and a greater number of legs might be provided to support the deck above the surface of the water.

Each of the legs 14, 16 and 18 is comprised of a column which depends from the deck 12 and a pad at the lower end of the column, the pads being provided to distribute the unbuoyed portion of the platform's weight and the weight of the equipment on the deck 12 over a large area of the seabed when drilling takes place. In particular, the leg 14 is comprised of a column 20 atop a pad 22; the leg 16 is comprised of a column 24 atop a pad 26; and the leg 18 is comprised of a column 28 atop a pad 30.

The platform 10 is provided with ballast tanks by the construction of the columns 20, 24 and 28 and the pads 22, 26 and 30, the columns and pads all having a hollow, compartmented structure as has been illustrated for the column 20 and pad 22 in FIG. 1. As shown in such Figure, the column 20 is a tube that is provided with a partition 32 to divide the interior of the column 20 into two vertically stacked ballast tanks 34 and 36. Similarly, the interior of the pad 22 is divided into a plurality of ballast tanks, five of which have been shown and designated by the numerals 38, 40, 42, 44 and 46 in FIG. 1, by a system of partitions indicated generally at 48 in FIG.

1. In order to pump water into and out of the ballast tanks formed in the legs 14, conventional pumps (not shown), valves (not shown) and conduits are disposed in the leg 14 and the pumps can be conveniently located in a pump house 52 disposed in central portions of the pad 22. Similarly positioned ballast tanks (not shown) and pump houses are formed in the columns 24 and 28 and in the pads 26 and 30 so that the platform 10 comprises a plurality of ballast tanks that are distributed both horizontally and vertically about the platform.

Figure 2:
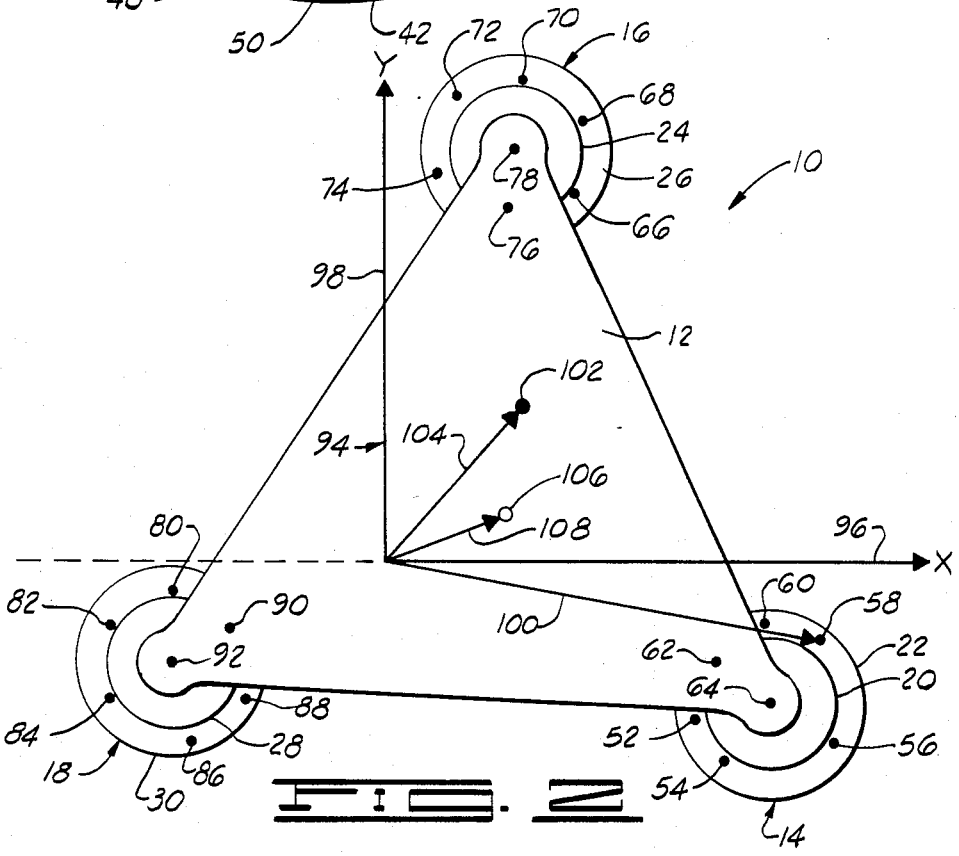
FIG. 2 is a plan view of the drilling platform of FIG. 1.

Before proceeding to an example of the ballasting method of the present invention, it will be useful to note the general features of the tanks and the distribution of the tanks on the platform 10. In general, the tanks will have differing shapes and capacities as has been illustrated for the tanks in the leg 14 in FIG. 1. The shapes and capacities are fixed at the time the platform 10 is built and information relating to the shapes and capacities of the ballast tanks will be available to the ballaster before ballasting of the platform 10 begins. Thus, the ballaster will know the capacity of each tank and its horizontal location on the platform 10; that is, the lateral displacement of the tank from any selected vertical line. The horizontal locations of the tanks can conveniently be selected to be the centroids of the horizontal cross sections of the tanks and can be displayed as a system of points on a plan view of the platform as shown in FIG. 2. Thus, in FIG. 2, the ballast tanks in the pad 22, including a tank not shown in FIG. 1, might have the horizontal locations indicated by the points: 52 (indicating the horizontal location of the tank 38); 54 (indicating the horizontal location of the tank 40); 56 (indicating the horizontal location of the tank 42); 58 (indicating the horizontal location of the tank 44); 60 (indicating the horizontal location of the tank 46); and 62 (indicating the horizontal location of a tank that has not been illustrated in FIG. 1). Similarly, the horizontal locations of each of the tanks 34 and 36 in the column 20, such tanks being disposed one above the other, are indicated by the point 64 in FIG. 2. The ballast tanks in the legs 16 and 18 would similarly have horizontal locations indicated by the points 66–76 for the tanks in the pad 26; the point 78 for the tanks in the column 24; the points 80–90 for the tanks in the pad 30; and the point 92 for the tanks in the column 28.

In addition to displaying the locations of the ballast tanks on a plan view of the platform 10, the ballaster can specify such locations analytically and such specification will facilitate the carrying out of the ballasting method as will become clear below. For analytic specification of the horizontal locations of the ballast tanks, the ballaster inpresses a coordinate system, such as the coordinate system 94, having X and Y axes 96 and 98 respectively, on the deck 12 of the platform 10. The origin of the coordinate system 94 and its orientation on the deck 12 can be selected in any convenient manner and have been arbitrarily chosen in FIG. 2. Once a coordinate system has been selected, each of the horizontal locations 52–92 of the ballast tanks can be specified by the horizontal displacement of the location from the origin of the coordinate system 94. Thus, for example, the horizontal location 58 of the tank 44 would be specified by the horizontal displacement 100 in FIG. 1. For clarity of illustration, the horizontal displacements from the origin of the coordinate system 94 to the horizontal locations of the remaining ballast tanks of the drilling platform 10 have not been illustrated in FIG. 2.

Returning now to FIG. 1, it will be seen that the ballast tanks with which the offshore drilling platform 10 is provided are not all on the same level below the deck 12. For example, in the leg 14, the ballast tank 34 in the column 20 is above the ballast tank 36 in such column and the tank 36, in turn, is above the ballast tanks 38–46 (as well as an additional tank which has not been illustrated) in the pad 22. A similar vertical distribution will exist for the ballast tanks in the legs 16 and 18. In accordance with one aspect of the invention, the ballaster can divide the totality of ballast tanks of the drilling platform 10 into groups based on the vertical distribution of the ballast tanks on the platform 10. Thus, for example, where the tanks are distributed in three tiers as shown in FIG. 1, the ballaster can divide the tanks into three groups: a first group comprising all tanks in the pads 22, 26 and 30; a second group comprising all tanks located immediately above the pads 22, 26 and 30 in the columns 20, 24 and 28 respectively; and a third group comprising the remaining tanks in the columns 20, 24 and 28.

As has been noted above, ballasting is carried out to cause the combined weight of the vessel and ballast to have a desired value which is determined by conventional methods to meet the circumstances at hand and, further, to cause the combined center of gravity of the vessel and ballast to have a similarly, conventionally selected location in the horizontal plane. The ballasting method of the present invention results in the weight of the vessel and ballast being within a selected tolerance of the conventionally determined desired vessel and ballast weight and further results in the combined center of gravity of the vessel and ballast lying within an acceptable horizontal distance of the conventionally determined desired center of gravity of the vessel and ballast. For purposes of discussion, the horizontal location of the desired center of gravity has been illustrated in FIG. 2 by a solid circle designated by the numeral 102 and the horizontal location of the desired center of gravity 102 conveniently can be specified in the same manner that the horizontal locations of the ballast tanks are specified; that is, via the horizontal displacement 104 of the desired center of gravity of the vessel and ballast from the origin of the coordinate system 94. (The vertical location of the desired center of gravity need not be considered in ballasting the platform 10).

In addition to knowing the locations of all of the ballast tanks of the vessel (the offshore drilling platform 10) and the capacities of the tanks, the ballaster will also know the quantities of water the tanks contain at the time that ballasting of the vessel begins. This information must be available for any ballasting method to be used and conventional methods are employed to insure that such information will be available to the ballaster. For example, the ballaster might measure the quantities of water in the ballast tanks prior to commencement of the ballasting method or such information may be available from records relating to the previous ballasting of the vessel. Moreover, the ballaster will know the weight and center of gravity of the vessel exclusive of ballast, such quantities having been determined when the vessel was built. Thus, before commencing the ballasting of the vessel, the ballaster can determine an initial combined weight of the vessel and ballast and an initial center of gravity of the vessel and ballast in the horizontal plane. These determinations are conventional and are carried out by adding the weight of water in each of the tanks to the weight of the unballasted vessel and by applying the definition of center of gravity to a model in which the vessel and quantities of water in the ballast tanks are treated as point masses distributed about the vessel.

In the conduct of the method, ballast adjustments are assigned to selected tanks of the vessel (the offshore drilling platform 10) and subsequently effected so that the weight of the vessel and ballast and the location of the center of gravity of the vessel and ballast will change as the ballasting method is carried out. In particular, the weight of the vessel and ballast may increase or decrease in accordance with whether a ballast adjustment is positive, corresponding to an additional quantity of water to be added to a ballast tank or negative, corresponding to a quantity of water to be pumped from a ballast tank of the vessel. In order that the ballaster may keep track of the overall weight of the vessel and ballast and the horizontal location of the overall center of gravity of the vessel and ballast, the present invention contemplates that the ballaster will employ a current vessel and ballast weight and a current vessel and ballast center of gravity. The current vessel and ballast weight is defined to include the weight of the unballasted vessel, the weight of any ballet initially disposed in the ballast tanks of the vessel, and any ballast adjustments, positive or negative, that have been assigned to ballast tanks of the vessel without regard to whether such adjustments have been effected. Similarly, the current vessel and ballast center of gravity is defined to be the center of gravity of a system comprised of (1) the unballasted vessel treated as a point mass at the horizontal location of the center of gravity of the unballasted vessel; (2) the initial quantities of water in the ballast tanks similarly treated as point masses at the ballast tank horizontal locations shown in FIG. 2; and (3) any adjustments assigned to the ballast tanks treated as positive or negative point masses at the ballast tanks horizontal locations in FIG. 2 and without regard to whether the adjustments have been effected. For purposes of illustrating the method, a representative horizontal location for the current vessel and ballast center of gravity has been indicated by an open circle in the drawings and designated by the numeral 106 therein. Such horizontal location will be the initial horizontal location of the center of gravity of the vessel and ballast as the method of the present invention commences and will shift about the horizontal plane as ballast adjustments are assigned to ballast tanks of the vessel. The location of the current vessel and ballast center of gravity can be specified by a horizontal displacement 108 from the origin of the coordinate system 94 to the location 106.

With this background, it will be useful to now consider the first of four examples of the conduct of the ballasting method of the present invention which, together, will illustrate the manner in which the method is carried out. It will, of course, be recognized that the method can be employed in other circumstances so that the examples are intended to be illustrative rather exhaustive.

For the first example, it is assumed that the vessel; that is, the offshore drilling platform 10, is afloat and that ballasting is desired to effect a small increase in the draft of the platform 10 while correcting the trim of the platform 10. Thus, the ballast adjustments are to be positive and a known, small shift is to be effected in the horizontal location of the center of gravity of the platform and ballast combined. The first step of the ballasting method is to select a subset of three tanks among the totality of ballast tanks of the platform 10 to which ballast adjustments are to be assigned and effected. In the circumstances under consideration; that is, the platform 10 is afloat and is to remain afloat, it is desirable that the ballasting of the platform 10 leave the vertical location of the center of gravity of the vessel and ballast as low on the platform 10 as possible so that the platform 10 will have a maximum stability at the conclusion of the ballasting of the platform 10. To meet this condition, the ballaster divides the ballast tanks of the platform 10 into the three groups that have been described above and selects the subset of three ballast tanks from among those ballast tanks in the lowermost group of tanks; that is, from among the tanks in the pads 22, 26 and 30. These tanks are then separated into available and non-available tanks in accordance with the contents of the tanks. Some tanks in the pads 22, 26 and 30 may have been previously filled to capacity in which case no additional ballast can be received by such tanks; that is, none of the positive ballast adjustments to be effected in the example at hand can be assigned to such tanks. These filled tanks are thus "non-available" tanks; the remaining tanks, some of which may be empty and some of which may contain ballast, are "available" tanks from which the subset is to be selected.

Figure 3:
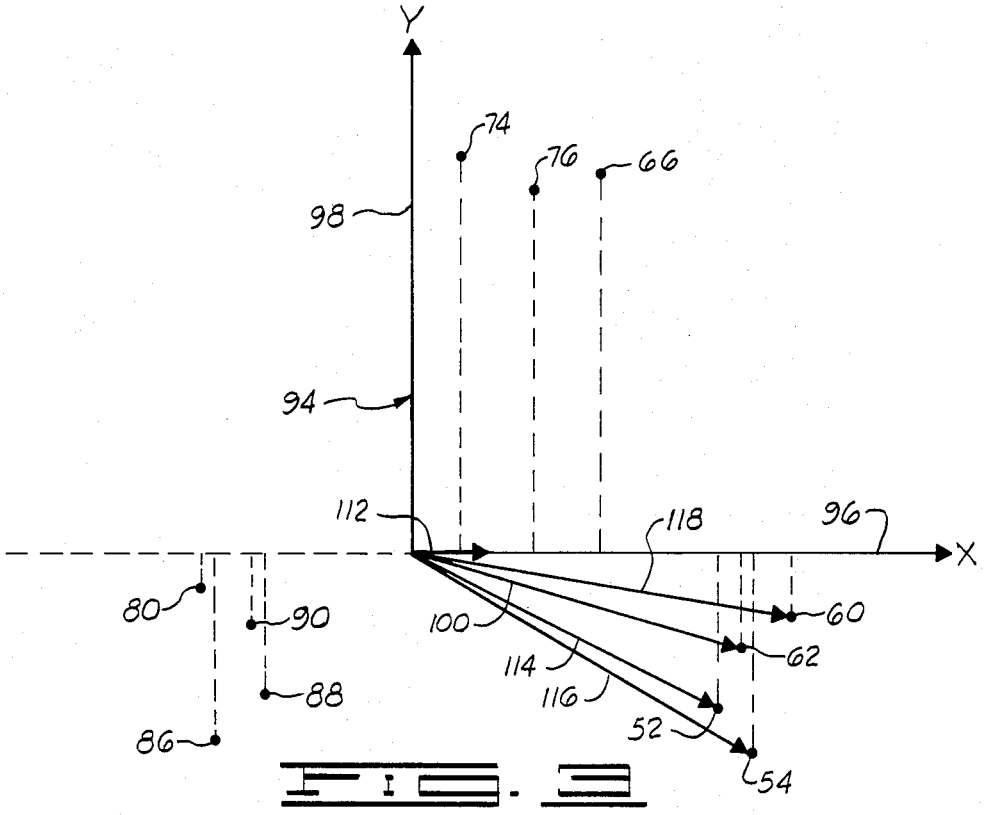
FIG. 3 is a graphical depiction of one manner of selecting the first two members of a three member subset of ballast tanks used to ballast the drilling platform.
Figure 4:
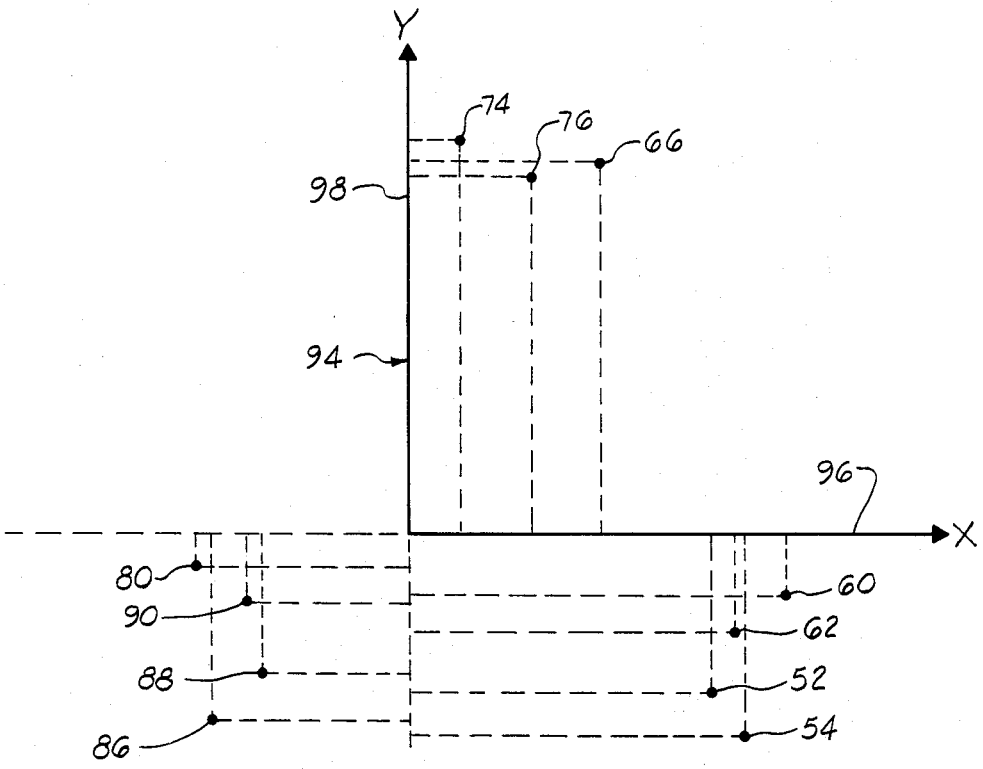
FIG. 4 is a graphical depiction of an alternative manner of selecting the first two members of the subset of ballast tanks.
Figure 5:
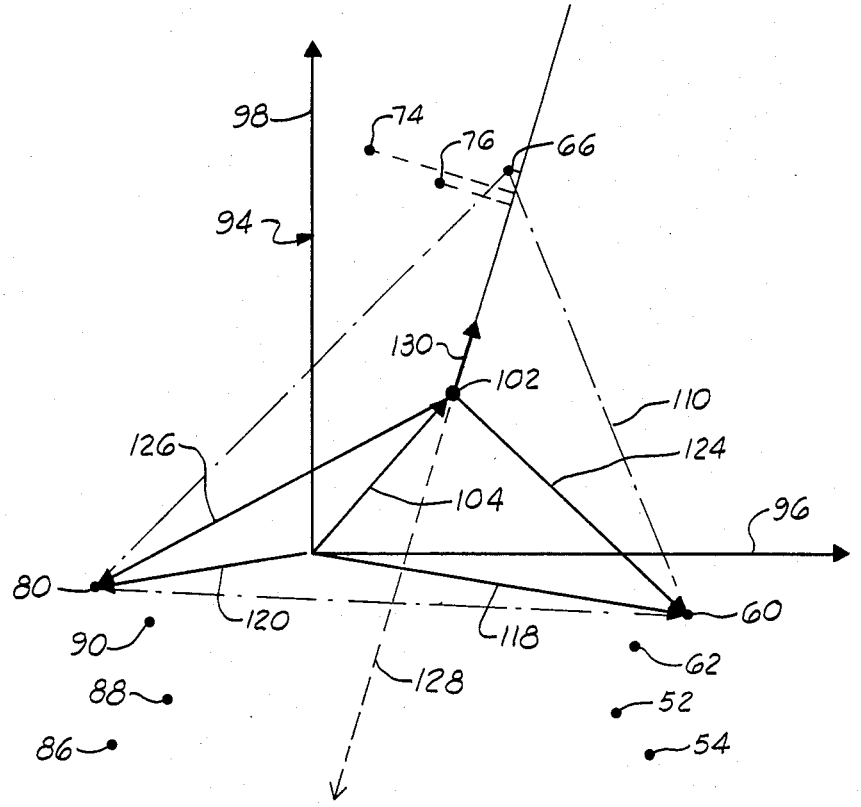
FIG. 5 is a graphical depiction of the manner in which the third member of the ballast tank subset is selected.

In some cases, previous ballasting of the platform 10 will have left all but three of the available tanks of the first group of tanks completely empty and the remaining tanks partially filled. If the three partially filled tanks meet a criterion to be discussed below, the ballaster may choose the three partially filled tanks as the subset of ballast tanks to which adjustments are to be assigned and effected. However, the method of the present invention contemplates that the ballast tank subset may be selected under any circumstances in which ballasting can be carried out to effect specified, desired results. Thus, for purposes of example, it will be considered that the ballaster chooses the subset from among all of the available tanks of the selected group of ballast tanks. In this case, the selection will be made in two stages and FIGS. 3 and 4 illustrate alternative modes of carrying out the first stage. FIG. 5 illustrates the second stage for the case in which the first stage of the subset selection has been carried out in accordance with FIG. 3.

Before describing the selection of the ballast tanks to form the three member subset, it will be useful to first note the criterion that the members of the subset are to meet and further to note a desirable feature in the subset selection. These have been illustrated in FIG. 5 in which the results of subset selection beginning with the first stage shown in FIG. 3 are illustrated. As will become clear from the discussion below, the tanks that will be selected for the subset, where the first stage of subset selection is carried out in accordance with the mode of selection illustrated in FIG. 3, will be tanks horizontally located at the points 60, 66 and 80 in FIG. 5.

The criterion that the selection of the members of the tanks of the subset is to satisfy is that the horizontal locations of the tanks define a triangle, indicated in phantom line in FIG. 5 and designated by the numeral 110 therein, that is disposed about the horizontal location 102 of the desired vessel and ballast center of gravity. When this criterion is met, it will always be possible to select a member of the subset to receive a ballast adjustment such that effecting the ballast adjustment will shift the current vessel and ballast center of gravity, as defined above, toward the desired vessel and ballast center of gravity. This condition on shifts caused by the effectuation of ballast adjustments determined in the conduct of the present method, in conjunction with the preferred manner of selecting the adjustments, causes the current vessel and ballast center of gravity to converge on the desired vessel and ballast center of gravity. FIGS. 3 through 5 illustrate a preferred manner of selecting the members of the subset of ballast tanks which will result in this triangle criterion being met for all but the most unusual circumstances which the ballaster might encounter. Should these unusual circumstances occur, the ballaster can graphically select any three ballast tanks which will meet the criterion. Should no three tanks exist for which the criterion can be met, the vessel cannot be ballasted to bring the center of gravity of the vessel and ballast to the desired location.

In addition to causing the subset selection to meet the above criterion, the manner of selecting the subset illustrated in FIGS. 3 through 5 also provides a desired characteristic of the subset in that such manner of selection will cause the members of the subset to be widely spaced on the vessel. In general, the center of gravity of the vessel and ballast will be located in central portions of the vessel for any acceptable ballast configuration so that wide dispersal of the members of the subset will cause ballast adjustments to have the greatest effect on the location of the center of gravity of the vessel and ballast. Thus, by always choosing each subset to have widely dispersed members, consistently with the availability of tanks from which the subset can be selected, the initial ballasting steps are caused to have the greatest effect on the location of the vessel and ballast center of gravity, to roughly position the vessel and ballast center of gravity in the vicinity of the desired center of gravity, and later steps, carried out with ballast adjustments of decreasing size, will tend to fine tune the location of the center of gravity of the vessel and ballast to within a small horizontal displacement of the desired vessel and ballast center of gravity. In the case of the ballasting of an offshore drilling platform having three legs, wide dispersal of the members of the subset generally can be achieved by selecting one of the members of the subset from among the tanks in each of the legs of the platform and the manner of selection that will be described will have this result. However, the selection stages discussed below also insure the wide dispersal of the members of the subset for other types of vessels and for offshore drilling platforms having more than three legs.

Referring now to FIG. 3, shown therein is a reproduction of the coordinate system 94 and selected ones of the ballast tank horizontal locations. For purposes of example, FIG. 3 has been drawn for the case in which the available tanks of the group of tanks comprised of all tanks in the pads 22, 26 and 30 are: tanks in pad 22 having horizontal locations at the points 52, 54, 60 and 62; tanks in the pad 26 having horizontal locations at the points 66, 74 and 76; and tanks in the pad 30 having horizontal locations at the points 80, 86, 88 and 90. The first stage in the selection of three tanks to form the subset of tanks used to ballast the platform 10 consists of selecting two tanks on the basis of location on the platform 10 and, in accordance with the mode illustrated in FIG. 3, such stage is carried out by projecting the horizontal locations of all of the available ballast tanks onto a horizontal line on the vessel. In particular, and as shown in FIG. 3, such line can be the X axis of the coordinate system 94 impressed on the deck 12 of the platform 10 as shown in FIG. 2. The first two members of the subset are then chosen to be the two tanks whose horizontal locations are most widely separated along the line upon which the ballast tank horizontal locations are projected; that is, the two tanks corresponding to the two most widely separated points on the line that is achieved by such projection. For the case in which the available ballast tanks have the horizontal locations shown in FIG. 3, the first two members of the subset would be the tank having the horizontal location at the point 60 (tank 46 in the pad 22 in FIG. 1) and the tank having the horizontal location at the point 80 in the drawings. The latter tank would be one of the non-illustrated ballast tanks disposed in the pad 30 in FIG. 1.

The selection of the first two members of the subset in the manner illustrated in FIG. 3 can be carried out graphically as shown in FIG. 3 and can also be carried out analytically. To this end, the scalar product between a unit vector 112 along the X axis and the horizontal displacement from the origin of the coordinate system 94 to each of the ballast tank locations; for example, the horizontal displacements 100 and 114–118 in FIG. 3, would be determined and the first two tanks of the subset would be those two tanks corresponding to the largest and smallest scalar products. (Depending upon the choice of location of the origin of the coordinate system 94, the smallest scalar product can be the smallest of a sequence of positive scalar products or the largest of a series of negative scalar products.) The analytical approach is particularly useful in the event that a programmable calculator or computer is used as an aide to carrying out the ballasting method. In such case, the horizontal displacements to the ballast tanks would be entered into the computer or calculator, by entering the components of the displacements, and the computer or calculator would be programmed to select the two tanks whose locations have the greatest and smallest X components as the first two members of the subset.

FIG. 4 illustrates an alternative manner of selecting the first two tanks of the subset from the tanks having the horizontal locations 52, 54, 60, 62, 66, 74, 76, 80, 86, 88 and 90. In FIG. 4, the horizontal locations of the tanks are projected onto both the X and Y axes of the coordinate system 94 and the tanks selected to be the first two members of the subset are those two tanks whose horizontal locations have the greatest X coordinate and greatest Y coordinate respectively. In FIG. 4, these tanks would be the ballast tanks having the horizontal ballast tank locations 60 and 74. As in the case of the identification of the first two tanks of the subset shown in FIG. 3, the identification of the first two members of the subset shown in FIG. 4 can be carried out analytically as well as graphically as shown in FIG. 4. The analytic identification of the first two members of the subset according to the selection mode indicated in FIG. 4 can be made by requiring that one of the tanks forming the subset be that tank for which the X component of the horizontal displacement from the origin of the coordinate system 94 to the ballast tanks is a maximum and the other tanks is that tank for which the Y componet of the horizontal displacement from the origin of the coordinate system 94 to the tank is a maximum.

The second stage of the subset selection is the selection of an additional ballast tank from among the available ballast tanks to complete the subset to which ballast adjustments are to be assigned. The manner in which such selection is made, when the first two members of the subset are selected in accordance with FIG. 3, has been illustrated in FIG. 5. In FIG. 5, the locations 60 and 80 are specified by the horizontal displacements 118 and 120 respectively from the origin of the coordinate system 94. From the horizontal displacements 118 and 120, and the horizontal displacement 104 to the desired center of gravity 102 of the vessel and ballast, horizontal displacements from the desired center of gravity 102 of the vessel and ballast to the tanks having the horizontal locations 60 and 80 can be determined by vector subtraction. That is, the horizontal displacement from the desired center of gravity 102 to the tank having the horizontal location 60 is the displacement 124 which is the vector difference between the horizontal displacement 118 and the horizontal displacement 104. Similarly, the horizontal displacement from the desired center of gravity 102 to the tank located by the point 80 is the vector difference between the horizontal displacement 120 and the horizontal displacement 104. To select the third member of the subset, the horizontal displacements 124 and 126 are added vectorially to determine their resultant 128 that has been indicated in dashed line in FIG. 5. The third member of the subset is then chosen to be that available ballast tank having the greatest component of horizontal displacement along a line, 130 in FIG. 5, extending from the desired center of gravity 102 oppositely from the resultantf 128. As can be seen in FIG. 5, such tank is the tank having the horizontal location indicated by the point 66 in FIG. 5. Such tank can be identified analytically by determining the scalar product between a unit vector 130 extending oppositely from the resultant 128 and the horizontal displacements of each of the remaining available tanks from the desired center of gravity 102. The tank having the largest such scalar product is chosen as the third member of the subset. In the case in which the first two tanks are chosen in accordance with FIG. 4, the third tank is selected by the same procedure as in the case in which the first two tanks are selected in accordance with FIG. 3. The only difference lies in the two initial tanks to which the procedure shown in FIG. 5 is applied.

Once the subset of ballast tanks has been selected, a series of ballast adjustments to be made to the tanks of the subset are selected in accordance with a preselected first criterion. In the example under consideration; that is, the ballasting of a floating drilling platform to effect a small increase in draft while adjusting the trim of the platform, a convenient first criterion is that each ballast adjustment be a selected fraction of the difference between the desired vessel and ballast weight and the current vessel and ballast weight that has been defined above. A fraction which has been found to be suitable when the first criterion is selected in this way is the fraction one sixth. As discussed below, the ballasting method is terminated when the combined weight of the vessel and ballast resulting from a sequence of ballast adjustments is within a preselected tolerance of the desired vessel and ballast weight. The fraction one sixth has been found to result in the sequence of ballast adjustments having enough members to insure convergence of the center of gravity of the vessel and ballast to within an acceptable distance of the desired center of gravity location 102. For example, should the vessel and ballast weight tolerance happen to be one tenth the difference between the weight of the vessel and ballast before and after ballasting, the use of the fraction one sixth to define the first criterion will result in thirteen ballast adjustments being made in the conduct of the ballasting method. Such number is not so large as to be inconvenient and not so small that the final location of the center of gravity of the vessel and ballast will be significantly displaced from the desired center of gravity 102. The selection of the first criterion to be a fraction of the difference between the desired and current weights of the vessel and ballast combined in particularly suited to the example under consideration; that is, the case in which the draft of a vessel is being only slightly increased, because the fraction can be chosen to be small enough that the effectuation of any ballast adjustment will be insufficient to cause the vessel to become unstable when the ballast adjustments are effected. Where stability during the effectuation of the ballast adjustments might be a problem, the first criterion can be selected in a different way that will be discussed below.

Figure 6:
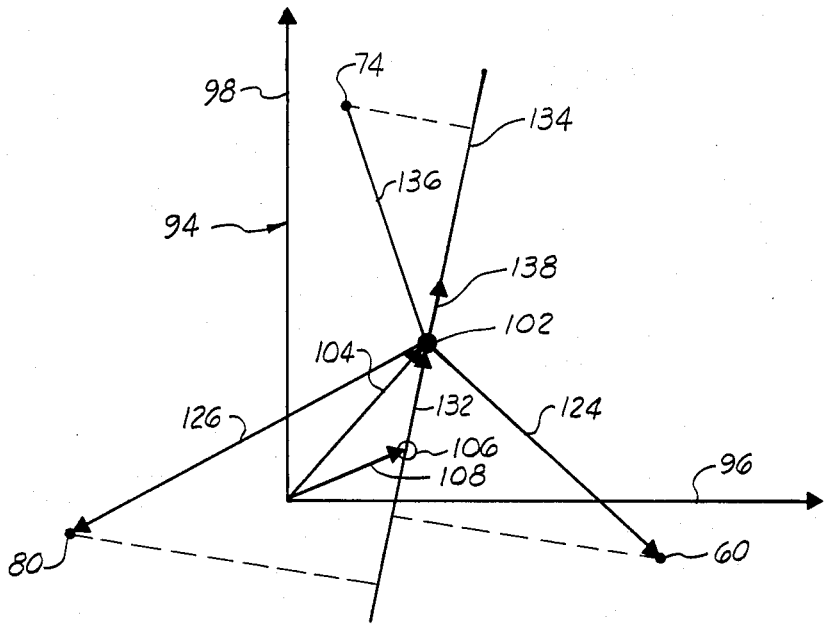
FIG. 6 is a graphical depiction of the manner in which a member of the ballast tank subset is selected to be assigned a ballast adjustment.

Once each ballast adjustment has been selected in accordance with the first criterion, one member of the subset is selected to be assigned the ballast adjustment in accordance with a second criterion that is applied in a manner that has been graphically illustrated in FIG. 6. The second criterion is that the member of the subset that is selected will result in each ballast adjustment, once effected, causing the greatest shift in the center of gravity of the vessel and ballast in the direction of the displacement from the current vessel and ballast center of gravity toward the desired vessel and ballast center of gravity. This displacment will change as the sequence of ballast adjustments are assigned because of the definition of the current vessel and ballast center of gravity to include the ballast adjustments. For purposes of example, a representative one of these displacements has been illustrated in FIG. 6 and designated by the numeral 132 therein.

To meet the second criterion, the line of the displacement 132 is extended to permit horizontal displacements of the members of the subset from the desired center of gravity 102; that is, the previously identified displacements 118 and 120 and the displacement 136 in FIG. 6, to be projected onto the line of the horizontal displacement 132 from the current center of gravity 106 to the desired center of gravity 102. In cases in which the ballast adjustments are positive, the ballast tank which meets the criterion is that tank for which such projection is the largest and is to the side of the desired center of gravity 102 from which the displacement 132 extends. In FIG. 6, the selected member of the subset is the ballast tank horizontally located at the point 74 since only this member of the subset yields a projection that is to the side of the desired center of gravity 102 from which the displacement 132 extends.

This criterion can also be met analytically. In particular, the scalar product between the displacements 118, 120 and 128 and a unit vector 138, having the same direction as the horizontal displacement 132 from the current center of gravity 106 to the desired center of gravity 102 can be found and that tank which yields the maximum, positive scalar product is the tank which satisfies the second criterion.

To arrive at a final ballast configuration, the above described ballast adjustment selection and assignment procedures are repeated until a third criterion is met. In some circumstances; in particular, circumstances that arise in situations such as the example under consideration in which the draft of a floating drilling platform is increased slightly while trimming the position of the platform in the water, only one subset of ballast tanks need be chosen to reach the desired final ballast configuration. In this case, the third criterion is that the current vessel and ballast weight, including the ballast adjustments as noted above, is brought to within a preselected tolerance of the desired vessel and ballast weight.

The method of the present invention contemplates that the actual addition of water to the ballast tanks to effect the ballast adjustments may be carried out in two ways. In some cases, it will be most convenient to select and assign all of the ballast adjustments prior to effecting any of the adjustments. That is, the ballaster makes note of each of the ballast adjustments and the tanks to which the adjustments are assigned so that, at the conclusion of the selection and assignment process, he will have a sequence of ballast adjustments and assignments which he can then follow in bringing the vessel to a proper ballast configuration. Since the ballast adjustments will have been chosen to insure that the vessel will be stable for any of the ballast configurations defined by the vessel having any one of the current vessel and ballast weights and having a center of gravity located at any one of the current vessel and ballast centers of gravity used to determine the ballast adjustments and assignments, a convenient way of effecting the ballast adjustments is to follow the order in which the ballast adjustments were selected and assigned. Alternatively, the ballaster can elect to effect each ballast adjustment as the ballast adjustment is selected and assigned. In either event, the overall result of carrying out the ballasting method of the present invention will be to place the center of gravity of the vessel and ballast within an acceptable horizontal displacement of the desired vessel and ballast center of gravity while increasing the weight of the vessel and ballast to within a preselected tolerance of the desired vessel and ballast weight chosen to cause the draft of the vessel to be within an acceptable tolerance of the desired vessel draft.

It will be noted that the definition of the current vessel and ballast weight and center of gravity to include the ballast assignments, whether the assignments have been effected or not, insures that the final ballast configuration will be the same regardless of the manner in which the ballast adjustments are effected. That is, should the ballaster chose to effect the ballast adjustments as they are selected and assigned, the current vessel and ballast weight and center of gravity will be the actual vessel and ballast weight and center of gravity that will be obtained at any time during the ballasting method. The inclusion of the ballast adjustments in the current vessel and ballast weight and center of gravity will insure the selection of the same sequence of ballast adjustments and the same sequence of assignments of the ballast adjustments without regard to whether the ballaster effects the adjustments at the time they are selected and assigned or effects the adjustments after all adjustments have been selected and assigned.

A second example that will further illustrate the ballasting method of the present invention is the ballasting of a drilling platform to lower the platform to the seabed. Since, in this case, a greater quantity of ballast will be added to the vessel ballast tanks than in the previous example, it cannot be expected that one subset of ballast tanks will suffice to achieve the final ballast configuration. The method of the present invention contemplates that any number of subsets, limited only by the availability of ballast tanks on the vessel can be sequentially selected to achieve the final ballast configuration. Moreover, the method of the present invention also contemplates that, in this second example, as in the first example, the method can be carried out with no danger of causing the vessel to pass through an unstable ballast configuration which might result in the vessel capsizing. It will be useful to consider these safety considerations first.

In many cases in which the vessel is a drilling platform being lowered to the seabed, the vessel will be in a substantially unloaded condition with the result that stability is not a critical factor. In this case, the ballaster may choose to dispense with the division of ballast tanks into groups located at various heights on the vessel. Rather, a subset may be selected from all the available ballast tanks; that is, from all the ballast tanks of the vessel which are not filled to capacity at the time ballasting of the vessel commences.

However, because of the greater quantity of ballast to be added to the ballast tanks than in the first example, the selection of the first criterion in the manner described above will, in many cases, not be desirable. In particular, if the first criterion by means of which the ballast adjustments are selected is that the ballast adjustment is to be a selected fraction of the difference between the desired weight for the vessel and ballast and the current weight of the vessel and ballast, ballast adjustments selected early in the conduct of the ballasting method can be large enough to cause the vessel to take on a large angle of heel when the effectuation of the ballast adjustments is carried out. Such heeling can give rise to damage occassioned by shifting of equipment remaining on the vessel. To avoid this problem, the first criterion in circumstances such as the example under consideration is selected to be the smaller of a selected fraction of the difference between the desired and current vessel and ballast weights and a selected fraction of the current vessel and ballast weight. Where the first criterion is based on the current vessel and ballast weight alone, a suitable fraction for the ballast adjustment is 1/100th of the current vessel and ballast weight.

As in the previous example, the first step in the ballasting method is to select a subset of ballast tanks to which ballast adjustments are assigned and effected. For the initial subset, the ballaster can use any of the procedures which have been discussed above with respect to the first example. That is, if all tanks but three are either empty or filled to capacity, these three tanks can be chosen as the initial subset. Alternatively, the procedures discussed above with respect to FIGS. 3 through 5 may be utilized.

Once the initial subset has been chosen, the ballasting method proceeds in a manner that is identical to the method described in the first example set out above, excepting only the above described change in the first criterion for selecting the size of each ballast adjustment, so long as the ballast adjustments are within the remaining capacities of tanks to which the ballast adjustments are assigned. In the example at hand, in which the ballast adjustments will add ballast to the ballast tanks, a ballast adjustment is within the remaining capacity of a ballast tank if the free volume of the tank is sufficient to receive the quantity of ballast defined by the adjustment and all previous ballast adjustments assigned to the tank. Thus, the ballaster will sequentially select ballast adjustments in accordance with the second criterion, chosen to be the smaller of two quantities of ballast as described above, and assign these adjustments to members of the initial subset in accordance with the procedure illustrated in FIG. 6 as has been described above.

To continue the ballasting method beyond the capacities of the three ballast tanks selected to commence the ballasting method, the ballaster selects the third criterion used to discontinue ballast adjustment selection and assignment to the initial subset in a manner that differs from the third criterion discussed above with respect to the first example. In particular, where several subsets are used, the third criterion for all but the final subset is that a selected ballast adjustment is not within the remaining capacity of a ballast tank to which the adjustment is assigned. In this case, the ballast adjustment is readjusted to equal just that amount necessary to exhaust the tank; that is, in the present example, to combine with other ballast adjustments assigned to the tank to fill the tank, and the ballaster then selects a new subset to which further ballast adjustments are to be assigned. Once the final subset is reached, the third criterion reverts to that described in the first example given above; that is, that the current weight of the vessel and ballast is within a preselected tolerance of the desired weight of the vessel and ballast.

The selection of each new subset of ballast tanks, where several subsets are used to ballast the vessel, can be carried out in the same manner that the initial subset was selected to begin the conduct of the method but a different selection mode, which will tend to limit the number of tanks having free ballast surfaces at the conclusion of the method, is preferred. In particular, since a new subset of ballast tanks is selected each time one tank of a subset is exhausted, two tanks of the previous subset will not be exhausted at the time that the new subset must be selected. In the preferred conduct of the method, these two tanks are selected as the first two members of the new subset and the third member is selected in the manner that has been illustrated in FIG. 5 and discussed above. The method is then continued, using a sequence of subsets from which individual ballast tanks are assigned ballast adjustments, until a ballast adjustment assigned to a member of one of the subsets will bring the current vessel and ballast weight within a preselected tolerance of the desired vessel and ballast weight. As in the case of the first example discussed above, the ballast adjustments can be effected as they are selected and assigned or the ballast adjustments can be recorded and effected once all adjustments have been selected and assigned. In the latter case for the present example, the ballast adjustments would be effected in the order in which they appear in a complete sequential listing of all ballast adjustments assigned to all members of all of the subsets used to carry out the ballasting method.

A third example which will further illustrate the method of the present invention is the ballasting of an offshore drilling platform to readjust the forces between the pads 22, 26 and 30 and the seabed as drilling proceeds. As drill pipe is taken from storage and added to the drill string extending into the borehole of an offshore well and new drill pipe is brought to the drilling platform, the forces between the pads and the seabed will increase and the distribution of these forces will change. That is, the forces exerted on the seabed by pads near the drilling rig on the platform will be increased more than forces exerted by pads farther from the drilling rig. Periodically, these forces are decreased and redistributed by ballasting the vessel to decrease the weight of the vessel and ballast and to shift the center of gravity of the vessel and ballast away from the drilling rig to equalize the forces the pads exert on the seabed.

The conduct of the ballasting method in this third example can be carried out in the same manner that the method is carried out in the first of the previous two examples by selecting negative ballast adjustments; that is, ballast adjustments which correspond to the pumping of ballast from the ballast tanks as opposed to pumping water into the ballast tanks. Correspondingly, the ballast tanks available to comprise a subset are ballast tanks which are not completely empty of ballast rather than ballast tanks which are not completely filled with ballast. With these changes, the subset of ballast tanks, or subsets where several subsets must be used, are selected in the same manner that has been described above for the case in which the ballast adjustments are positive and the first criterion for the selection of the ballast adjustments can be either of the first criteria discussed above. That is, the size of each ballast adjustment can be a selected fraction of the current vessel and ballast weight or a selected fraction of the difference between this weight and the desired vessel and ballast weight. The second criterion for the assignment of each ballast adjustment to a member of a subset will similarly be the same as the second criterion described above; that is, a subset member is selected to be assigned a ballast adjustment on the basis that such selection will cause the greatest horizontal shift of the current vessel and ballast center of gravity toward the desired vessel and ballast center of gravity. However, the manner in which this criterion is achieved is modified from the manner described above with respect to FIG. 6 to take into account the negative value of the ballast adjustment as will now be explained.

Returning to FIG. 6, it will be seen that the effectuation of a positive ballast adjustment assigned to the tank located at the point 74 will shift the current center of gravity 106 generally toward the desired center of gravity 102. However, where the adjustment is negative, the effectuation of the adjustment to the same tank, by pumping ballast from the tank, would shift the current center of gravity 106 away from the desired center of gravity 102. Thus, instead of assigning the ballast adjustment to the tank located at the point 74, the adjustment would be assigned to the tank located by the point 80 which has the greatest negative projection on the line 134 in the direction of the displacement 132 from the current center of gravity to the desired center of gravity. This selection can be made analytically by assigning the ballast adjustment to the ballast tank for which the scalar product of the unit vector 138 with each of the horizontal displacements of the tanks forming the subset from the desired center of gravity has the largest negative value.

At times, the redistribution of forces between the platform pads 22, 26 and 30 and the seabed will occur at frequent intervals so that only one subset of tanks will be used to ballast the drilling platform in carrying out the redistribution. In this case, the ballasting method can be carried out in a way that is completely analogous to the manner in which the draft of the platform is slightly increased while adjusting the trim of the platform, the only differences being the changes involving the use of negative ballast adjustments that has been described. However, since the platform in the present example is at rest on the seabed so that the possibility that the platform will capsize is not a problem, the ballaster may choose to effect the ballast adjustments in a manner not yet discussed. In particular, the ballaster may in this case, as well as in any other case in which the possibility of the vessel capsizing is not a problem, effect the ballast adjustments simultaneously or in some other order that differs from the order in which the ballast adjustments are selected and assigned to ballast tanks. For simultaneous ballast adjustment effectuation, the ballast adjustments are all selected and assigned prior to the effectuation of any adjustments and the pumps in the platform legs 14, 16 and 18 are then operated simultaneously while valves to the tanks are opened in accordance with the tanks to which adjustmens have been assigned. As the totality of adjustments assigned to each tank are effected, for example, where the total amount of ballast pumped from a ballast tank becomes equal to several negative ballast adjustments assigned to that tank, the valves to that tank are closed.

As a final example illustrating the ballasting method of the present invention, it will be suitable to consider the ballasting of a drilling platform at rest on the seabed to achieve neutral buoyancy preparatory to lifting the platform from the seabed. In this case, the ballast adjustments will again be negative so that the second criterion for the assignment of ballast adjustments will be achieved as has been discussed in the third of the examples above in which the forces the pads of the drilling platform exert on the seabed are redistributed.

In this present, fourth, example, the possibility of the platform capsizing, once the platform has been floated, again becomes an important consideration. Because of this safety factor the ballaster would again divide the tanks into groups on the basis of height and again make the initial subset selection from those available tanks; i.e., tanks not completely empty, in the highest group of tanks on the vessel. These could be the uppermost tanks in each of the columns 20, 24 and 28 of the drilling platform 10. Thus, for at least the first part of the ballasting method, the ballasting of the drilling platform to achieve neutral buoyancy would be analogous to slightly increasing the draft of the platform. However, it can be expected that, in many cases, the assignment of the negative ballast adjustments and the effectuation of these ballast adjustments to only one subset of ballast tanks will not be sufficient to bring the drilling platform 10 to neutral buoyancy. In this case, a new subset must be selected each time a member of a subset is exhausted, by assigning thereto a ballast adjustment sufficient to completely empty such member, and the preferred manner of selecting the new subset is to choose the two non-exhausted members of the subset as the first two members of the new subset and to select the tank immediately below the exhausted member as the third member of the subset. Should both ballast tanks in any column of the platform legs become exhausted, the third member of a new subset to continue the ballasting method would be selected from among the tanks in the pad underlying such column in the manner that has been illustrated in FIG. 5 and discussed above.

Figure 7:
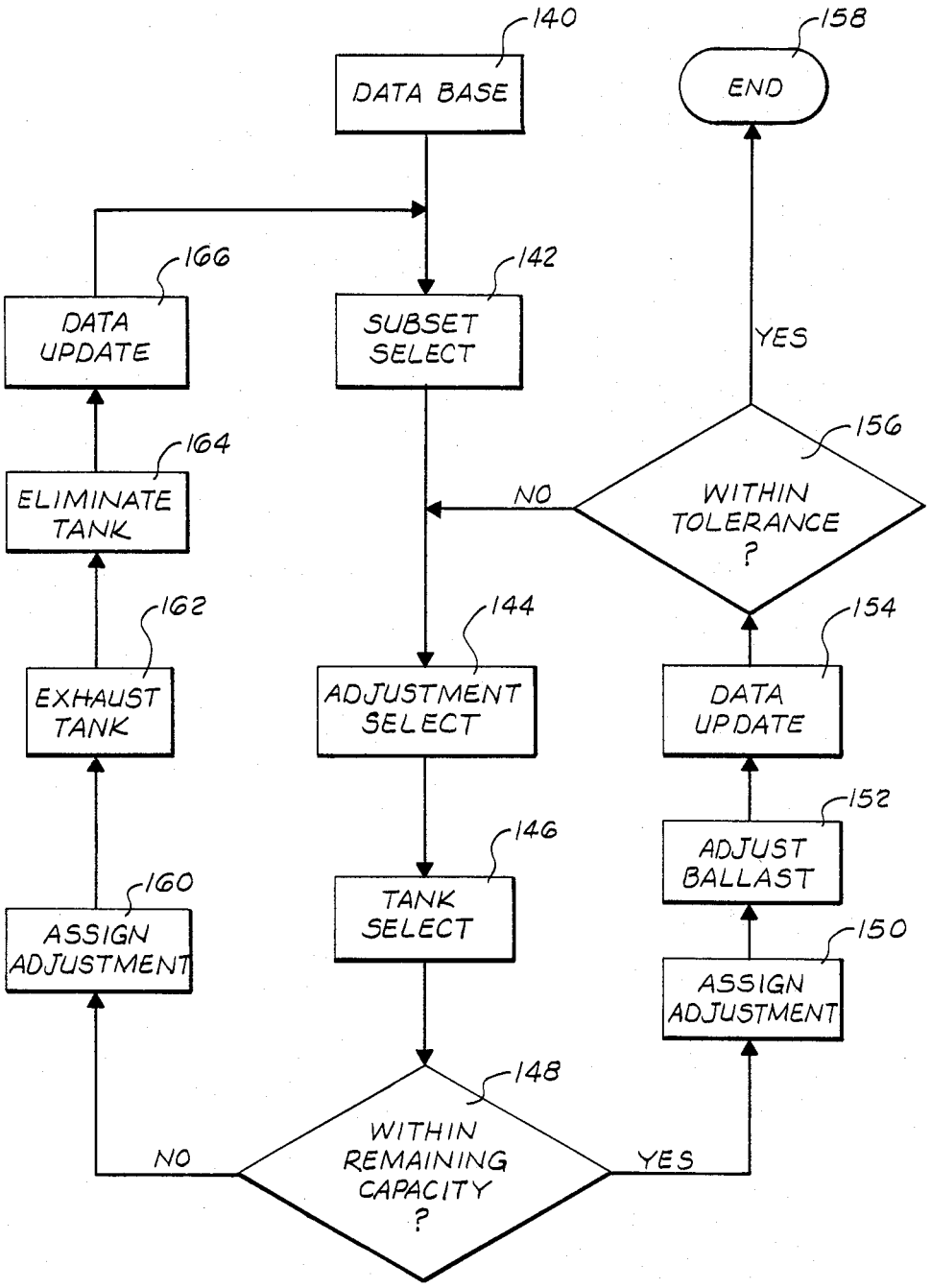
FIG. 7 is a flow chart illustrating one preferred sequence of steps for effecting the ballasting method of the present invention.
Figure 3:
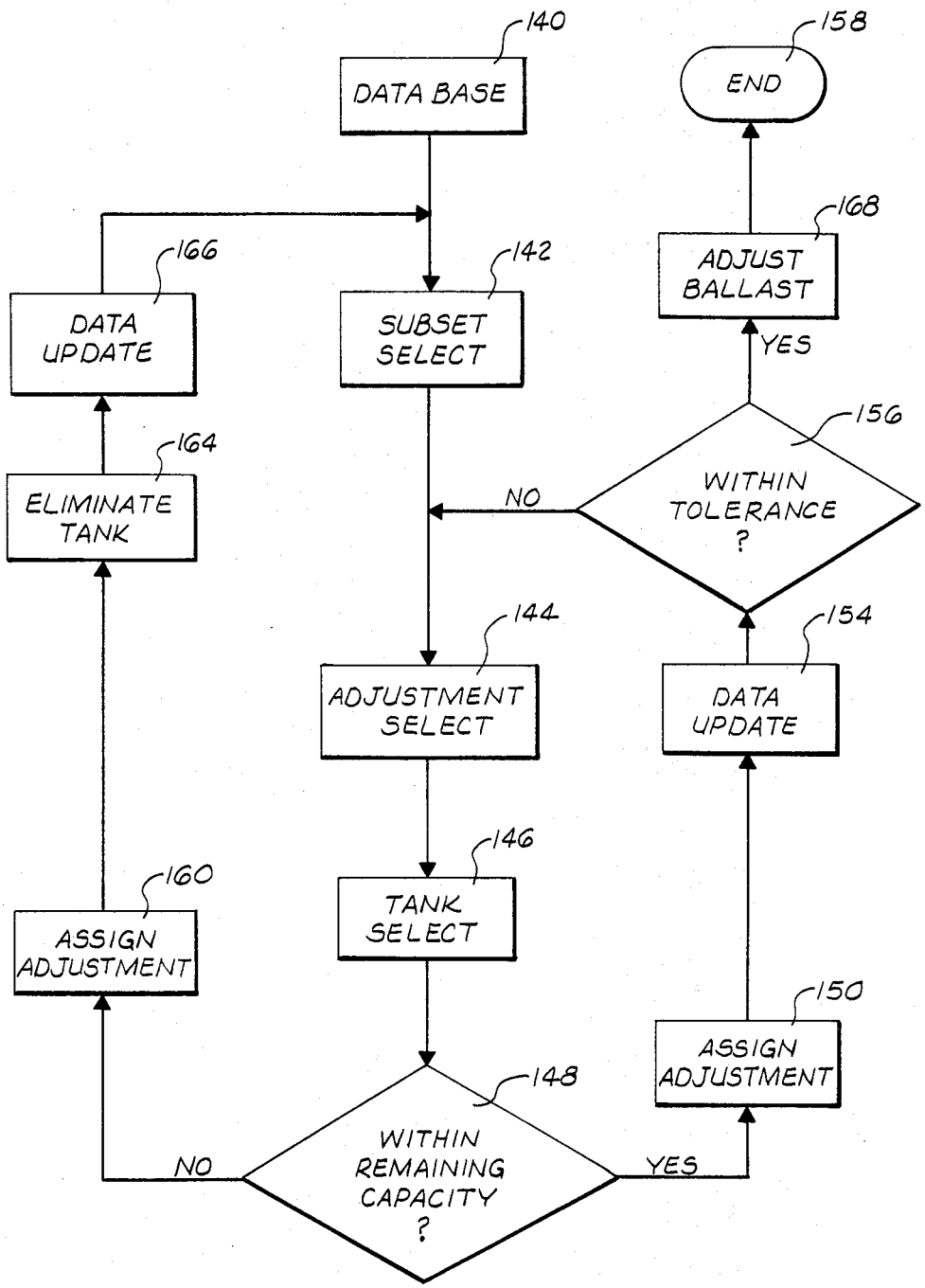

It will now be useful to summarize the ballasting method of the present invention and FIGS. 7 and 8 have been provided for this purpose. FIG. 7 is a flow chart that contemplates effectuation of the ballast adjustments as the adjustments are assigned and is applicable to each of the examples described above. FIG. 8 is a flow chart that contemplates a listing of the ballast adjustments as they are assigned for later effectuation and is similarly applicable to each of the examples described above.

Referring first to FIG. 7, the data base indicated at 140 therein is comprised of the information the ballaster has at the commencement of the ballasting method. This information includes: the desired vessel and ballast weight; the desired location of the vessel and ballast center of gravity; the locations and capacities of all ballast tanks of the vessel; the quantities of ballast in each of the ballast tanks; the tolerance between the desired and current vessel and ballast weights that the ballaster has selected to terminate the ballasting method; and the first criterion by means of which each ballast adjustment is to be selected.

The method begins with a subset selection as indicated by the arrow from the data base 140 to the subset select step indicated at 142 in FIG. 7. This selection can be made in any of the ways that have been discussed above; for example, by selecting three tanks from among a group of tanks using the techniques illustrated in FIGS. 3 and 5. In general, the selection will be made in accordance with the ends the ballaster is trying to achieve.

Once the subset has been selected, the ballaster proceeds to an adjustment selection step, indicated at 144 in FIG. 7, and such selection step can be made in either of the two ways discussed above. That is, the ballaster can subtract the current vessel and ballast from the desired vessel and ballast weight and use a fraction, such as one sixth, of the difference as the ballast adjustment or the ballaster may use a selected fraction of the current vessel and ballast weight for the ballast adjustment. In the first case, the ballast adjustment automatically will be positive in circumstances in which ballasting is to be accomplished by adding ballast to the ballast tanks of the vessel and negative in circumstances in which ballasting is to be accomplished by removing ballast from the ballast tanks of the vessel. In the second case, the ballaster requires the ballast adjustment to be positive or negative as the circumstances demand.

With the ballast adjustment selected, the ballaster proceeds to a tank select step 146 in which a member of the subset is selected to receive the ballast adjustment. This step is accomplished as has been described above with reference to FIG. 6 and is selected to meet the second criterion that effectuation of the ballast adjustment to the selected tank will cause the maximum possible shift of the current vessel and ballast center of gravity toward the desired vessel and ballast center of gravity that can be achieved by effecting the ballast adjustment to a member of the subset.

If the ballast adjustment is within the remaining capacity of the selected ballast tank, as indicated at 148 in FIG. 7, the ballaster assigns the ballast adjustment to the selected tank, as indicated at 150 in FIG. 7. This will often be the case of the initial ballast adjustment assignments and, it has been assumed in discussing the above examples, will be the case in the first and third of the examples discussed above. However, the flow chart of FIG. 7 also applies to the above examples in which a ballast adjustment is not within the remaining capacity of the selected tank as would, at times, be the case in the second and fourth examples discussed above. For purposes of the present discussion, it will be useful to first consider that the ballast adjustment is within the remaining capacity of the selected tank and to treat the case in which the ballast adjustment is not within the remaining capacity of the selected tank below.

Following the assignment of the ballast adjustment at step 150 in FIG. 7, the ballaster effects the adjustment by introducing a quantity of ballast equal to the ballast adjustment into the selected ballast tank or by pumping such quantity of ballast from the ballast tank. This step has been indicated at 152 in FIG. 7 and is followed by a data update step indicated at 154. The data update step comprises the changing of information the ballaster has concerning the vessel and ballast to reflect the effect of the ballast adjustment. This includes updating the quantity of ballast in the tank to which the adjustment has been made and updating the current vessel and ballast weight and center of gravity. In the case of weight, the ballast adjustment, positive or negative as the case may be, is added to the weight of the vessel and ballast prior to the ballast adjustment assignment. The center of gravity update is carried out by applying the definition of center of gravity to a system comprised of two point masses, one point mass being located at the center of gravity of the vessel and ballast prior to the assignment of the adjustment and being equal in magnitude to the total weight of the vessel and ballast prior to such assignment and the other point mass being a weight, equal to the weight of the ballast adjustment just defined, located at the position of the tank to which the ballast adjustment is assigned. It will be noted that this update can be carried out on the basis of the ballast adjustments and their assignments without regard to whether any adjustment is actually effected. The method of the present invention contemplates such updating by including ballast adjustments, whether effected or not, in the definition of the current vessel and ballast weight and current vessel and ballast center of gravity that has been noted above. That is, the current weight of the vessel and ballast includes the weight of the vessel alone, the weight of any ballast in the ballast tanks of the vessel, and the weight, positive or negative, of any ballast adjustment assigned to ballast tanks of the vessel and the current center of gravity of the vessel and ballast is the center of gravity determined from the distribution of the weight of the vessel alone, the distribution of actual amounts of ballast in the ballast tanks, and the distribution of ballast adjustments among the ballast tanks of the vessel. In the case under consideration in which the ballasting is carried out in accordance with FIG. 7, the ballast adjustments are absorbed in the actual quantities of ballast disposed in the ballast tanks via the effectuation of the ballast adjustments following the assignment of the ballast adjustments to the ballast tanks.

Following the data update 154, the ballaster compares the new current vessel and ballast weight with the desired vessel and ballast weight to determine whether the current vessel and ballast weight is within the preselected tolerance of the desired vessel and ballast weight as indicated at 156 in FIG. 7. If the current vessel and ballast weight is within the preselected tolerance, the ballaster terminates the method as indicated by the end step 158 in FIG. 7. However, because of the manner in which the ballast adjustments are selected, a number of ballast adjustments will be require so that the third criterion that the current vessel and ballast weight be within the preselected tolerance will not be met by the selection and assignment of the first ballast adjustment. In this case, the ballaster returns to the adjustment select step 144 to repeat the steps 144 through 156 in FIG. 7. (These steps are repeated without digression in the case in which one ballast tank subset will suffice to ballast the vessel. The case in which more than one subset is needed will be discussed below). The sequence of steps 144–156 is then repeated as many times as needed to bring the current vessel and ballast weight within the preselected tolerance of the desired vessel and ballast weight. When this criterion is met, the ballaster proceeds to step 158 which terminates the ballasting method.

In the case in which a large change is made to the vessel and ballast; for example, in circumstances such as those described in the second and fourth of the examples discussed above, more than one subset will be used in the ballasting of the vessel. In this case, the ballaster initially follows the procedure that he follows in ballasting a vessel using only one subset of ballast tanks. In particular, so long as each ballast adjustment is within the remaining capacity of the ballast tank to which the adjustment is assigned, the ballaster repetitively follows the steps 144–146 using the subset of ballast tanks that he initially selects. He digresses from this repetition only when a ballast adjustment is not within the remaining capacity of a tank selected to be assigned such adjustment. In this case, the third criterion that terminates the repetition of ballast adjustment and assignment steps is that the ballast adjustment is not within the remaining capacity of the tank selected to receive the ballast adjustment. That is, the adjustment calls for adding more ballast to the selected tank than the tank can receive in addition to other amounts of ballast in the tank or assigned thereto, in the case in which the ballast adjustments are positive, or the ballast adjustment, in combination with previously assigned ballast adjustments, calls for pumping more ballast in the tank than the tank contains. When this occurs, the ballaster reduces the ballast adjustment to that value which will exhaust the selected tank, either by filling the tank or emptying the tank, and proceeds to an adjustment assignment step indicated at 160 in FIG. 7 in which the reduced ballast adjustment is assigned to the selected tank.

Following the assignment of the reduced ballast adjustment in FIG. 7, the ballaster effects the adjustment to exhaust the selected ballast tank as indicated at 162 in such Figure. That is, he fills the tanks to capacity where the vessel and ballast weight is being increased and empties the tank where the vessel and ballast weight is being decreased.

Following the exhaustion of the ballast tank, the ballaster eliminates the exhaust ballast tank from further consideration in the ballasting method, as indicated at 164 in FIG. 7, and carries out a data update step 166 that is identical to the data update step 154. (The size of the ballast adjustment used to carry out the data update step 166 will, of course, be the ballast adjustment that has actually been assigned to the exhausted tank.)

Following the data update step 166, the ballaster returns to the subset select step 142 and selects a new subset of ballast tanks using any of the techniques described in the above examples and again commences a repetition of the steps of selecting ballast adjustments and assigning the ballast adjustments to selected ones of the subset that has been outlined as steps 144–156 in FIG. 7. Should the ballast tanks in the new subset have remaining capacities sufficient to receive all further ballast adjustments assigned thereto in the repetition of the steps 144–156, the ballasting method will proceed by repetition of these steps until the current vessel and ballast weight is within the preselected tolerance of the desired vessel and ballast weight and the ballaster then terminates the method. On the other hand, if the new ballast tank subset will not enable this criterion to be reached, the ballaster will repeat steps 144–156 until he again assigns a ballast adjustment to a tank that exceeds the remaining capacity of that tank. He then repeats steps 160–166 and step 142 shown in FIG. 7 before again taking up the repetition of steps 144–156. Since each ballast adjustment assignment will bring the current vessel and ballast weight closer to the desired vessel and ballast weight and since a number of ballast adjustment assignments are made with each repetition of the steps 144–156, the occasional repetition of steps 160–166 and step 142 will eventually result in the selection of a subset of ballast tanks for which the repetition of steps 144–156 will suffice to bring the current vessel and ballast weight within the preselected tolerance of the desired vessel and ballast weight. The ballaster then completes the ballasting method by the repetition of the steps 144–156 using such subset of ballast tanks.

FIG. 8 is a flow chart that illustrates a modification of the ballasting method described with respect to FIG. 7. In the method illustrated in FIG. 8, the ballaster follows the same steps as in FIG. 7 excepting that the adjust ballast step 152 and the exhaust tank step 162 are eliminated and an adjust ballast step 168 is added following the step 156 in which the current vessel and ballast weight is tested against the desired vessel and ballast weight to determine whether the difference in these weights is within the preselected tolerance. The adjust ballast step 168 is carried out ony after the criterion that the two weights are within the tolerance has been met so that all ballast adjustments are selected and assigned before any ballast adjustment is effected. Since the data update steps 154 and 166 are based on the assignment of the ballast adjustments by the definition of the current vessel and ballast weight and the current vessel and ballast center of gravity to include the ballast adjustment whether the adjustments have been effected or only assigned, the modified method illustrated in FIG. 8 will yield a sequence of ballast adjustments and assignments that are the same as the sequence of ballast adjustments and assignments provided by the unmodified method illustrated in FIG. 7. FIG. 8 thus contemplates that the ballaster will record the sequence of ballast adjustments and assignments and effect the adjustments only after all adjustments and assignments have been selected. In most circumstances, the adjust ballast step 168 will then follow the recorded sequence of ballast adjustments so that the same safety features that are built into the unmodified method illustrated in FIG. 7 will be achieved when the vessel is ballasted in accordance with the modified method illustrated in FIG. 8. However, the modified method permits the ballaster to speed the conduct of the ballasting method in circumstances in which safety; in particular, safety against capsizing of the vessel, does not present a problem. In such case, the adjust ballast step 168 can be carried out by simultaneously effecting different ones of the ballast adjustments instead of effecting the ballast adjustments in accordance with the recorded sequence. Such simultaneous effectuation of the adjustments is carried out by pumping ballast to or from the selected tanks at the same time as has been discussed above.

As has been noted, the conduct of the method of the present invention can be facilitated using a programmable calculator or a computer to aid the ballaster in carrying out the method. In such case, a computer or programmable calculator is particularly suited for carrying out the subset selection, adjustment selection, tank selection and adjustment assignment steps using the analytical techniques for selecting subsets and selecting members of subsets to be assigned ballast adjustments that have been discussed above. In addition, the computer or calculator can be programmed to automatically carry out the data update steps once a ballast adjustment has been selected and assigned to a ballast tank. To program the computer or calculator, the ballaster can conveniently make use of the flow charts which have been illustrated in FIGS. 7 and 8.

The following is a specific program listing, following the flow chart shown in FIG. 8, to be utilized in conjunction with a specific off-shore drilling vessel for use in a Hewlett Packard Corporation computer model HP41 CV:

PROGRAM LISTING

```
01♦LBL "69
       SCHD"
02 DEG
03 CLRG
04 "NEW WT?
          "
05 PROMPT
06 STO 51
07 "NEW LCG
          ?"
08 PROMPT
09 STO 52
10 "NEW TCG
          ?"
11 PROMPT
12 STO 53
13 "OLD WT?
          "
36 RDN
37 "⊢ WT?"
38 PROMPT
39 X=0?
40 GTO 63
41 STO IND
          00
42 XEQ "NEW
          G"
43 -1
44 ST* IND
          00
45 GTO 63

46♦LBL 64
47 FIX 2
48 XEQ "BAL
          L"
49 BEEP
72 -1
73 ST* IND
          62
74 RDN
75 XEQ "NEW
          G"
76 XEQ "INC
          R"
77 XEQ "SEL
          ECT"
78 GTO 51

79♦LBL 65
80 ST+ IND
          62
81 X<>Y
82 RDN
83 XEQ "NEW
          G"
```

```
14 PROMPT
15 STO 54
16 "OLD LCG
        ?"
17 PROMPT
18 STO 55
19 "OLD TCG
        ?"
20 PROMPT
21 STO 56
22 18
23 STO 57
24 24
25 STO 58
26 FIX 0

27◆LBL 63
28 1
29 ST+ 00
30 RCL 00
31 RCL 58
32 X<>Y
33 X>Y?
34 GTO 64
35 XEQ IND
        00
```

```
50 XEQ "DSP
        LY"
51 RTN

52◆LBL "BAL
        L"
53 0
54 STO 59
55 STO 60
56 STO 61
57 XEQ "INC
        R"
58 XEQ "SEL
        ECT"

59◆LBL 51
60 XEQ "WHI
        CH?"
61 RCL IND
        62
62 STO 62
63 XEQ IND
        62
64 R↑
65 -
66 CHS
67 RCL 00
68 X<Y?
69 GTO 65
70 RDN
71 ST+ IND
```

```
84 RCL 51
85 RCL 54
86 -
87 RCL 51
88 /
89 1 E-5
90 X>Y?
91 RTN
92 XEQ "INC
        R"
93 GTO 51

94◆LBL "WHI
        CH?"
95 RCL 52
96 RCL 55
97 -
98 RCL 53
99 RCL 56
100 -
101 R-P
102 X<>Y
103 STO 63
104 58
105 STO 64
106 180
107 STO 65
```

```
108◆LBL 59
109 1
110 ST+ 64
111 RCL 64
112 62
113 X=Y?
114 RTN
115 RCL IND
        64
116 XEQ IND
        X
117 RDN
118 RCL 53
119 -
120 RCL 52
121 ST- Z
122 RDN
123 R-P
124 X<>Y
125 RCL 63
126 -
127 ABS
128 RCL 65
129 X<Y?
130 GTO 59
131 X<>Y
132 STO 65
133 RCL 64
```

```
150 +
151 RCL 54
152 RCL 63
153 +
154 /
155 STO 56
156 X<>Y
157 RCL 63
158 *
159 RCL 54
160 RCL 55
161 *
162 +
163 RCL 54
164 RCL 63
165 +
166 STO 54
167 /
168 STO 55
169 RTN

170◆LBL "SEL
        ECT"
171 RCL 59
172 X≠0?
173 GTO 54
174 RCL 60
175 X≠0?
```

```
192 X<0?
193 GTO 56
194 RDN
195 RCL 64
196 X>Y?
197 GTO 61
198 X<>Y
199 STO 64
200 RCL 63
201 STO 59
202 GTO 56

203◆LBL 61
204 RDN
205 RCL 65
206 X<Y?
207 GTO 56
208 X<>Y
209 STO 65
210 RCL 63
211 STO 60
212 GTO 56

213◆LBL 54
214 RCL IND
        59
215 X<0?
216 GTO 57
```

```
134 STO 62
135 GTO 59

136◆LBL "INC
          R"
137 RCL 51
138 RCL 54
139 -
140 6
141 /
142 STO 00
143 RTN

144◆LBL "NEW
          G"
145 STO 63
146 *
147 RCL 54
148 RCL 56
149 *
229 RDN
230 RCL 53
231 -
232 CHS
233 X<>Y
234 RCL 52
235 -
236 CHS
237 X<>Y
238 R-P
239 X<>Y
240 X<0?
241 XEQ 66
242 STO 63
243 XEQ IND
          60
244 RDN
245 RCL 53
246 -
247 CHS
248 X<>Y
249 RCL 52
250 -
251 CHS
252 X<>Y
253 R-P
254 X<>Y
255 X<0?
256 XEQ 66
257 RCL 63
258 +
259 2
260 /
261 STO 64
262 RCL 63
263 -
264 ABS
265 STO 63
266 90
```

```
176 GTO 54
177 RCL 61
178 X≠0?
179 GTO 54
180 STO 63
181 RCL 53
182 STO 64
183 STO 65

184◆LBL 56
185 1
186 ST+ 63
187 RCL 63
188 RCL 57
189 X<Y?
190 GTO 55
191 XEQ IND
          63

276◆LBL 52
277 1
278 ST+ 65
279 RCL 65
280 RCL 67
281 X<Y?
282 GTO 53
283 X<>Y
284 RCL 59
285 X=Y?
286 GTO 52
287 X<>Y
288 RCL 60
289 X=Y?
290 GTO 52
291 X<>Y
292 XEQ IND
          65
293 X<0?
294 GTO 52
295 RDN
296 RCL 53
297 -
298 X<>Y
299 RCL 52
300 -
301 X<>Y
302 R-P
303 X<>Y
304 X<0?
305 XEQ 66
306 RCL 64
307 -
308 ABS
309 RCL 63
310 X<Y?
311 GTO 52
312 RDN
313 COS
```

```
217 RCL IND
          60
218 X<0?
219 GTO 58
220 GTO 55

221◆LBL 57
222 RCL 60
223 STO 59

224◆LBL 58
225 RCL 61
226 STO 60

227◆LBL 55
228 XEQ IND
          59

323◆LBL 53
324 RCL 61
325 X>0?
326 RTN
327 RCL 67
328 RCL 58
329 "INSUF T
        ANKS"
330 X=Y?
331 AVIEW
332 STO 67
333 1
334 ST- 65
335 GTO 52

336◆LBL 66
337 360
338 +
339 RTN

340◆LBL 67
341 CHS
342 180
343 ST+ 64
344 +
345 STO 63
346 RCL 64
347 360
348 X<Y?
349 ST- 64
350 RTN

351◆LBL "DSP
          LY"
352 0
353 STO 00

354◆LBL 60
355 1
```

```
267 X<>Y
268 X>Y?
269 XEQ 67
270 0
271 STO 65
272 STO 66
273 STO 61
274 RCL 57
275 STO 67
362 ABS
363 "⊢= "
364 ARCL X
365 R↑
366 X=Y?
367 "⊢F"
368 AVIEW
369 GTO 60

370◆LBL 62
371 "WT="
372 ARCL 54
373 AVIEW
374 "LCG="
375 ARCL 55
376 AVIEW
377 "TCG="
378 ARCL 56
379 AVIEW
380 RTN

381◆LBL 01
382 "P1"
383 569.67
384 14.84
385 -91.79
386 RCL 01
387 RTN

388◆LBL 02
389 "P2"
390 484.28
391 32.43
392 -117.5
393 RCL 02
394 RTN

395◆LBL 03
396 "P3"
397 498.25
398 16.22
399 -145.58
400 RCL 03
401 RTN

402◆LBL 04
403 "P4"
404 569.67
405 -14.84
406 -143.21
314 *
315 RCL 66
316 X<>Y
317 X<=Y?
318 GTO 52
319 STO 66
320 RCL 65
321 STO 61
322 GTO 52
409◆LBL 05
410 "P5"
411 569.67
412 -29.68
413 -117.5
414 RCL 05
415 RTN

416◆LBL 06
417 "P6"
418 569.67
419 -14.84
420 -91.79
421 RCL 06
422 RTN

423◆LBL 07
424 "S1"
425 569.67
426 14.84
427 91.79
428 RCL 07
429 RTN

430◆LBL 08
431 "S2"
432 242.14
433 -8.69
434 85.07
435 RCL 08
436 RTN

437◆LBL 09
438 "S3"
439 747.38
440 -29.53
441 109.59
442 RCL 09
443 RTN

444◆LBL 10
445 "S4"
446 569.67
447 -14.84
448 143.21
449 RCL 10
450 RTN
356 ST+ 00
357 RCL 00
358 RCL 58
359 X<Y?
360 GTO 63
361 XEQ IND
00

451◆LBL 11
452 "S5"
453 890.21
454 19.42
455 136.06
456 RCL 11
457 RTN

458◆LBL 12
459 "S6"
460 221.19
461 32.43
462 108.81
463 RCL 12
464 RTN

465◆LBL 13
466 "A1"
467 569.67
468 173.84
469 0
470 RCL 13
471 RTN

472◆LBL 14
473 "A2"
474 242.14
475 179.78
476 23.74
477 RCL 14
478 RTN

479◆LBL 15
480 "A3"
481 747.38
482 211.43
483 29.53
484 RCL 15
485 RTN

486◆LBL 16
487 "A4"
488 569.67
489 233.2
490 0
491 RCL 16
492 RTN
```

```
407 RCL 04
408 RTN

493◆LBL 17
494 "A5"
495 569.67
496 218.36
497 -25.71
498 RCL 17
499 RTN

500◆LBL 18
501 "A6"
502 569.67
503 188.68
504 -25.71
505 RCL 18
506 RTN

507◆LBL 19
508 "P7"
509 770.52
510 0
511 -117.5
512 RCL 19
513 RTN

514◆LBL 20
515 "P8"
516 1593.35
517 0
518 -117.5
519 RCL 20
520 RTN

521◆LBL 21
522 "S7"
523 770.52
524 0
525 117.5
526 RCL 21
527 RTN

528◆LBL 22
529 "S8"
530 1593.35
531 0
532 117.5
533 RCL 22
534 RTN

535◆LBL 23
536 "A7"
537 775.28
538 203.52
539 0
540 RCL 23
541 RTN

542◆LBL 24
543 "A8"
544 1593.35
545 203.52
546 0
547 RCL 24
548 RTN
549 END
```

The ballast program can be altered to produce intermediate results, thus permitting recommended ballast increments to be called out as the vessel operator actually performs the ballasting sequence in accordance with the flow chart shown in FIG. 7. The following outlines the necessary changes for converting the program to operation in this mode.

PROGRAM ALTERATIONS

The required changes to the program consist of the following:

(1) The "INCR" subroutine should be altered to list as shown below.

```
138  *  LBL "INC
            R"
139     RCL 51
140     RCL 54
141     —
142     6
143     /
144     RCL 54
145     100
146     /
147     X>Y?
148     X<>Y
149     STO 00
150     RTN
```

(2) An additional subroutine, labeled "ITRMDT" (short for intermediate), should be added. This subroutine will consist of the following 15 lines.

```
177  *  LBL "ITR
            MDT"
178     RCL IND
                62
179     ABS
180     "  ="
181     ARCL X
182     AVIEW
183     "LCG="
184     ARCL 55
185     AVIEW
186     "TCG="
187     ARCL 56
188     AVIEW
189     ADV
190     ADV
191     RTN
```

(3) Two execution statements need to be added to the main program, one after each "New G" execution statement. The additions are indicated below.

```
.
.
.
72      -1
```

-continued

```
                73      ST* IND
                                62
                74      RDN
                75      XEQ "NEW
                                G"
Additional  →   76      XEQ "ITR
Line                            MDT"
                77      XEQ "INC
                                R"
                78      XEQ "SEL
                                ECT"
                79      GTO 51
                8Ø    * LBL 65
                81      ST+ IND
                                62
                82      X<>Y
                83      RDN
                84      XEQ "NEW
                                G"
Additional  →   85      XEQ "ITR
Line                            MDT"
                86      RCL 51
                87      RCL 54
                88      —
                89      RCL 51
                9Ø      /
                91      1 E−5
                92      X>Y?
                93      RTN
                94      XEQ "INC
                                R"
                95      GTO 51
                          .
                          .
                          .
```

It is clear that the present invention is well adapted to carry out the objects and attain the ends and advantages mentioned as well as those inherent therein. While a presently preferred embodiment of the invention has been described for purposes of this disclosure, numerous changes may be made which will readily suggest themselves to those skilled in the art and which are encompassed within the spirit of the invention disclosed and as defined in the appended claims.

What is claimed is:

1. A method for ballasting a vessel having a plurality of ballast tanks, comprising the steps of:

(a) at least once selecting a subset of three ballast tanks from among said plurality of ballast tanks;

(b) selecting a ballast adjustment to be made to one tank of the subset in accordance with a preselected first criterion;

(c) assigning the ballast adjustment to a particular one of the tanks of the subset in accordance with a preselected second criterion;

(d) repeating steps (b) and (c) until a preselected third criterion is met; and (e) effecting the ballast adjustments.

2. The method of claim 1 wherein the step of selecting a subset of ballast tanks comprises the steps of:

(a) dividing the totality of ballast tanks of the vessel into a plurality of groups; and (b) selecting the subset from among the tanks of one group of the ballast tanks of the vessel.

3. The method of claim 2 wherein the step of selecting the subset from among the tanks of one group of ballast tanks of the vessel comprises the steps of:

(a) dividing said one group of ballast tanks into available and non-available tanks, the non-available tanks being comprised of all tanks of said one group that are completely filled with ballast and the available tanks being comprised of the remaining tanks of said one group;

(b) imposing a horizontal, two-dimensional coordinate system on the vessel so as to define X and Y coordinates for all tanks of the vessel;

(c) selecting as the first member of the subset that available tank having the greatest X coordinate;

(d) selecting as the second member of the subset that available tank having the greatest Y coordinate; and (e) selecting as the third member of the subset that available tank horizontally most remote from a preselected, desired vessel and ballast center of gravity along a line extending from said desired vessel and ballast center of gravity in a direction opposite the vector sum of the horizontal displacements of the first two members of the subset from said desired vessel and ballast center of gravity.

4. The method of claim 2 wherein the step of selecting the subset from among the tanks of one group of ballast tanks of the vessel comprises the steps of:

(a) dividing said one group of ballast tanks into available and non-available tanks, the non-available tanks being comprised of all tanks of said one group that are completely empty of ballast and the available tanks being comprised of the remaining tanks of said one group;

(b) imposing a horizontal, two-dimensional coordinate system on the vessel so as to define X and Y coordinates for all tanks of the vessel;

(c) selecting as the first member of the subset that available tank having the greatest X coordinate;

(d) selecting as the second member of the subset that available tank having the greatest Y coordinate; and (e) selecting as the third member of the subset that available tank horizontally most remote from a preselected, desired vessel and ballast center of gravity along a line extending from said desired vessel and ballast center of gravity in a direction opposite the vector sum of the horizontal displacements of the first two members of the subset from said desired vessel and ballast center of gravity.

5. The method of claim 2 wherein the step of selecting the subset from among the tanks of one group of ballast tanks of the vessel comprises the steps of:

(a) dividing said one group of ballast tanks into available and non-available tanks, the non-available tanks being comprised of all tanks of said one group that are completely filled with ballast and the available tanks being comprised of the remaining tanks of said one group;

(b) selecting a horizontal line on the vessel;

(c) selecting as the first two members of the subset those two available tanks having the greatest separation parallel to said horizontal line; and (d) selecting as the third member of the subset that available tank horizontally most remote from a preselected, desired vessel and ballast center of gravity along a line extending from said desired vessel and ballast center of gravity in a direction opposite the vector sum of the horizontal displacements of the first two members of the subset from said desired vessel and ballast center of gravity.

6. The method of claim 2 wherein the step of selecting the subset from among the tanks of one group of ballast tanks of the vessel comprises the steps of:

(a) dividing said one group of ballast tanks into available and non-available tanks, the non-available tanks being comprised of all tanks of said one group that are completely empty of ballast and the available tanks being comprised of the remaining tanks of said one group;

(b) selecting a horizontal line on the vessel;

(c) selecting as the first two members of the subset those two available tanks having the greatest separation parallel to said horizontal line; and (d) selecting as the third member of the subset that available tank horizontally most remote from a preselected, desired vessel and ballast center of gravity along a line extending from said desired vessel and ballast center of gravity in a direction opposite the vector sum of the horizontal displacements of the first two members of the subset from said desired vessel and ballast center of gravity.

7. The method of claim 1 wherein the step of selecting a subset of three ballast tanks comprises the steps of:

(a) dividing the totality of the ballast tanks of the vessel into available and nonavailable tanks, the nonavailable tanks being comprised of all tanks of the vessel that are completely filled with ballast and the available tanks being comprised of the remaining tanks of the vessel;

(b) imposing a horizontal, two-dimensional coordinate system on the vessel so as to define X and Y coordinates for all tanks of the vessel;

(c) selecting as the first member of the subset that available tank having the greatest X coordinate;

(d) selecting as the second member of the subset that available tank having the greatest Y coordinate; and (e) selecting as the third member of the subset that available tank horizontally most remote from a preselected, desired vessel and ballast center of gravity along a line extending from said desired vessel and ballast center of gravity in a direction opposite the vector sum of the horizontal displacements of the first two members of the subset from said desired vessel and ballast center of gravity.

8. The method of claim 1 wherein the step of selecting a subset of three ballast tanks comprises the steps of:

(a) dividing the totality of the ballast tanks of the vessel into available and nonavailable tanks, the nonavailable tanks being comprised of all tanks of the vessel that are completely empty of ballast and the available tanks being comprised of the remaining tanks of the vessel;

(b) imposing a horizontal, two-dimensional coordinate system on the vessel so as to define X and Y coordinates for all tanks of the vessel;

(c) selecting as the first member of the subset that available tank having the greatest X coordinate;

(d) selecting as the second member of the subset that available tank having the greatest Y coordinate; and (e) selecting as the third member of the subset that available tank horizontally most remote from a preselected, desired vessel and ballast center of gravity along a line extending from said desired vessel and ballast center of gravity in a direction opposite the vector sum of the horizontal displacements of the first two members of the subset from said desired vessel and ballast center of gravity.

9. The method of claim 1 wherein the step of selecting a subset of three ballast tanks comprises the steps of:

(a) dividing the totality of the ballat tanks of the vessel into available and nonavailable tanks, the nonavailable tanks being comprised of all tanks of the vessel that are completely filled with ballast and the available tanks being comprised of the remaining tanks of the vessel;

(b) selecting a horizontal line on the vessel;

(c) selecting as the first two members of the subset those two available tanks having the greatest separation parallel to said horizontal line; and (d) selecting as the third member of the subset that available tank horizontally most remote from a preselected, desired vessel and ballast center of gravity along a line extending from said desired vessel and ballast center of gravity in a direction opposite the vector sum of the horizontal displacements of the first two members of the subset from said desired vessel and ballast center of gravity.

10. The method of claim 1 wherein the step of selecting a subset of three ballast tanks comprises the steps of:

(a) dividing the totality of the ballast tanks of the vessel into available and nonavailable tanks, the nonavailable tanks being comprised of all tanks of the vessel that are completely empty of ballast and the available tanks being comprised of the remaining tanks of the vessel;

(b) selecting a horizontal line on the vessel;

(c) selecting as the first two members of the subset those two available tanks having the greatest separation parallel to said horizontal line; and (d) selecting as the third member of the subset that available tank horizontally most remote from a preselected, desired vessel and ballast center of gravity along a line extending from said desired vessel and ballast center of gravity in a direction opposite the vector sum of the horizontal displacements of the first two members of the subset from said desired vessel and ballast center of gravity.

11. The method of claim 1 wherein said first criterion for selecting a ballast adjustment is that the ballast adjustment is a preselected fraction of the difference between a preselected, desired vessel and ballast weight and a current vessel and ballast weight, said current vessel and ballast weight including all ballast adjustments previously assigned to tanks of the vessel.

12. The method of claim 1 wherein said first criterion for selecting a ballast adjustment is that the ballast adjustment is the lesser of (a) preselected fraction of the difference between a preselected desired vessel and ballast weight and a current vessel and ballast weight and (b) a preselected fraction of the current vessel and ballast weight, said current vessel and ballast weight including all ballast adjustments previously assigned to tanks of the vessel.

13. The method of claim 1 wherein said second criterion for assigning the ballast adjustment to a particular one of the tanks of the subset is that the ballast adjustment made to said particular one of the tanks of the subset will produce the greatest horizontal shift in the center of gravity of the vessel and ballast along a line directed from a current vessel and ballast center of gravity toward a preselected, desired vessel and ballast center of gravity, said current vessel and ballast center of gravity including the effect on the location of the vessel and ballast center of gravity of all ballast adjustments previously assigned to tanks of the vessel.

14. The method of claim 1 wherein said preselected third criterion terminating the repetition of the ballast adjustment selection and ballast adjustment assignment steps is that the current vessel and ballast weight is within a preselected tolerance of a preselected, desired total vessel and ballast weight, said current vessel and ballast weight including all ballast adjustments assigned to ballast tanks of the vessel.

15. The method of claim 1 wherein a sequence of subsets are selected to ballast the vessel; wherein, for each subset, the method comprises the steps of repetitively selecting ballast adjustments to be assigned to tanks of the subset and assigning the selected ballast adjustments to particular ones of the tanks of the subset until the preselected third criterion is met; wherein, for all subsets except the last of the sequence of subsets of tanks of the vessel, said third criterion is that a ballast adjustment assigned to a particular one of the tanks of the subset, together with previous ballast adjustments assigned to such tank of the subset, is sufficient to completely fill such one of the tanks of the subset; and wherein said third criterion for the last subset of the sequence of subsets is that a current vessel and ballast weight is within a preselected tolerance of a preselected, desired vessel and ballast weight, said current vessel and ballast weight including all ballast adjustments assigned to ballast tanks of the vessel.

16. The method of claim 1 wherein a sequence of subsets are selected to ballast the vessel; wherein, for each subset, the method comprises the steps of repetitively selecting ballast adjustments to be assigned to tanks of the subset and assiging the selected ballast adjustments to particular ones of the tanks of the subset until the preselected third criterion is met; wherein, for all subsets except the last of the sequence of subsets of tanks of the vessel, said third criterion is that a ballast adjustment assigned to a particular one of the tanks of the subset, together with previous ballast adjustments assigned to such tank of the subset, is sufficient to completely empty such one of the tanks of the subset; and wherein said third criterion for the last subset of the sequence of subsets is that a current vessel and ballast weight is within a preselected tolerance of a preselected, desired vessel and ballast weight, said current vessel and ballast weight including all ballast adjustments assigned to ballast tanks of the vessel.

17. The method of claim 1 wherein each ballast adjustment is effected immediately following the steps of selecting the ballast adjustment and assigning the ballast adjustment to a particular one of the tanks of the subset.

18. The method of claim 1 in which the ballast adjustments are effected in the order in which ballast tanks are selected to receive the adjustments.

19. The method of claim 1 wherein the vessel is an offshore drilling platform.

* * * * *